US012796781B2

(12) United States Patent
Bock et al.

(10) Patent No.: US 12,796,781 B2
(45) Date of Patent: Nov. 17, 2026

(54) ARTICLE OF FOOTWEAR HAVING ADAPTIVE ACTUATION MECHANICS

(71) Applicant: PUMA SE, Herzogenaurach (DE)

(72) Inventors: Markus Bock, Herzogenaurach (DE); Yihyun Lim, Somerville, MA (US); Robert Panossian, Glendale, CA (US); Tim Robinson, Quincy, MA (US); Malik Coville, San Francisco, CA (US); Federico Casalegno, San Francisco, CA (US)

(73) Assignee: PUMA SE, Herzogenaurach (DE)

( * ) Notice: Subject to any disclaimer, the term of this patent is extended or adjusted under 35 U.S.C. 154(b) by 433 days.

(21) Appl. No.: 17/076,098

(22) Filed: Oct. 21, 2020

(65) Prior Publication Data

US 2021/0112922 A1 Apr. 22, 2021

Related U.S. Application Data

(60) Provisional application No. 62/923,919, filed on Oct. 21, 2019.

(51) Int. Cl.

| | |
|---|---|
| ***A43C 1/00*** | (2006.01) |
| ***A43B 3/34*** | (2022.01) |
| ***A43B 3/44*** | (2022.01) |
| ***A43B 23/08*** | (2006.01) |

(52) U.S. Cl.

CPC ..... *A43B 23/088* (2013.01); *A43B 3/34* (2022.01); *A43B 3/44* (2022.01); *A43C 1/006* (2013.01)

(58) Field of Classification Search

CPC ..... A43B 23/088; A43B 3/34; A43B 7/20; A43B 5/1691; A43C 1/006; A43C 11/165

See application file for complete search history.

(56) References Cited

U.S. PATENT DOCUMENTS

| | | | | |
|---|---|---|---|---|
| 4,724,626 A | | 2/1988 | Baggio | |
| 4,741,115 A | | 5/1988 | Pozzobon | |
| 4,748,726 A | | 6/1988 | Schoch | |
| 4,787,124 A | | 11/1988 | Pozzobon et al. | |
| 4,870,761 A | * | 10/1989 | Tracy | A43C 1/04 24/712 |
| 4,922,634 A | | 5/1990 | Seidel | |

(Continued)

FOREIGN PATENT DOCUMENTS

| | | |
|---|---|---|
| CA | 2500150 A1 | 9/2006 |
| CN | 2540805 Y | 3/2003 |

(Continued)

OTHER PUBLICATIONS

Japanese Office Action from corresponding Japanese Patent Application No. 2019-525884, dated Aug. 25, 2020 (English translation included) (8 pages).

(Continued)

*Primary Examiner* — Katharine G Kane

(74) *Attorney, Agent, or Firm* — Quarles & Brady, LLP

(57) ABSTRACT

An article of footwear includes a sole structure comprising a midsole, an upper attached to the sole structure, and an adaptive actuation system coupled to the upper. The adaptive actuation system includes a cable configured to compress a portion of the upper in response to movement of at least one of the sole structure or the upper by the user.

15 Claims, 21 Drawing Sheets

(56) References Cited

U.S. PATENT DOCUMENTS 4,937,953 A * 7/1990 Walkhoff ..... A43C 11/165 36/117.7
4,961,544 A 10/1990 Bidoia
5,051,095 A 9/1991 Slenker
5,206,804 A 4/1993 Thies et al.
5,325,613 A 7/1994 Sussmann
5,724,265 A 3/1998 Hutchings
5,755,044 A * 5/1998 Veylupek ..... A43C 3/00 36/50.1
5,839,210 A 11/1998 Bernier et al.
5,955,667 A 9/1999 Fyfe
5,983,530 A 11/1999 Chou
6,018,705 A 1/2000 Gaudet et al.
6,032,387 A 3/2000 Johnson
6,052,654 A 4/2000 Gaudet et al.
6,088,936 A * 7/2000 Bahl ..... A43C 1/00 36/89
6,189,239 B1 * 2/2001 Gasparovic ..... A43B 13/141 36/102
6,202,953 B1 * 3/2001 Hammerslag ..... A43C 11/00 242/396.2
6,289,558 B1 9/2001 Hammerslag
6,427,361 B1 8/2002 Chou
6,430,843 B1 8/2002 Potter et al.
6,691,433 B2 2/2004 Liu
6,865,825 B2 3/2005 Bailey, Sr. et al.
6,876,947 B1 4/2005 Darley et al.
6,882,955 B1 4/2005 Ohlenbusch et al.
6,892,477 B2 5/2005 Potter et al.
6,978,684 B2 12/2005 Nurse
7,082,701 B2 8/2006 Dalgaard et al.
7,096,559 B2 8/2006 Johnson
7,188,439 B2 3/2007 DiBenedetto et al.
7,310,895 B2 12/2007 Whittlesey et al.
7,503,131 B2 3/2009 Nadel et al.
7,607,243 B2 10/2009 Berner, Jr. et al.
7,721,468 B1 5/2010 Johnson et al.
7,752,774 B2 7/2010 Ussher
7,794,101 B2 9/2010 Galica et al.
D648,110 S 11/2011 Rasmussen
8,046,937 B2 11/2011 Beers et al.
8,056,269 B2 11/2011 Beers et al.
8,058,837 B2 11/2011 Beers et al.
8,061,061 B1 11/2011 Rivas
8,074,379 B2 12/2011 Robinson, Jr. et al.
8,277,401 B2 10/2012 Hammerslag et al.
8,387,282 B2 3/2013 Baker et al.
8,424,168 B2 4/2013 Soderberg et al.
8,468,657 B2 6/2013 Soderberg et al.
8,474,146 B2 7/2013 Hartford et al.
8,516,662 B2 8/2013 Goodman et al.
D689,684 S 9/2013 McMillan
8,522,456 B2 9/2013 Beers et al.
8,528,235 B2 9/2013 Beers et al.
8,676,541 B2 3/2014 Schrock et al.
8,678,541 B2 3/2014 Uchiyama
8,713,820 B2 5/2014 Kerns et al.
8,739,639 B2 6/2014 Owings et al.
8,769,844 B2 7/2014 Beers et al.
D718,036 S 11/2014 McMillan
8,904,672 B1 12/2014 Johnson
8,904,673 B2 12/2014 Johnson et al.
8,935,860 B2 1/2015 Torres
9,072,341 B2 7/2015 Jungkind
D740,538 S 10/2015 Roulo
9,149,089 B2 10/2015 Cotterman et al.
9,204,690 B1 12/2015 Alt et al.
D746,558 S 1/2016 Campbell et al.
9,241,539 B1 1/2016 Keswin
9,248,040 B2 2/2016 Soderberg et al.
D750,879 S 3/2016 Klein et al.
9,301,573 B2 4/2016 Jasmine
9,307,804 B2 4/2016 Beers et al.
D756,621 S 5/2016 Weddle
9,326,566 B2 5/2016 Beers et al.
9,365,387 B2 6/2016 Beers et al.
9,380,834 B2 7/2016 Rushbrook et al.
D768,977 S 10/2016 Seamarks et al.
9,462,844 B2 10/2016 Schrock et al.
9,532,893 B2 1/2017 Beers et al.
9,578,926 B2 2/2017 Alt et al.
9,609,918 B2 4/2017 Beers
9,610,185 B2 4/2017 Capra et al.
9,629,418 B2 4/2017 Rushbrook et al.
9,693,605 B2 7/2017 Beers
9,706,814 B2 7/2017 Converse et al.
9,756,895 B2 9/2017 Rice et al.
9,763,489 B2 9/2017 Amos et al.
9,861,164 B2 1/2018 Beers et al.
9,861,165 B2 1/2018 Schneider et al.
9,867,417 B2 1/2018 Beers et al.
9,872,539 B2 1/2018 Beers
9,907,359 B2 3/2018 Beers
9,918,865 B2 3/2018 Nickel et al.
D814,776 S 4/2018 Odinot
D815,413 S 4/2018 Weddle
9,943,139 B2 4/2018 Beers et al.
9,961,963 B2 5/2018 Schneider et al.
9,993,046 B2 6/2018 Bock
10,004,295 B2 6/2018 Gerber
10,010,129 B2 7/2018 Beers et al.
10,034,512 B2 7/2018 Rushbrook et al.
10,046,942 B2 8/2018 Beers et al.
10,070,681 B2 9/2018 Beers et al.
10,070,683 B2 9/2018 Rushbrook et al.
10,076,462 B2 9/2018 Johnson et al.
D829,425 S 10/2018 Albrecht et al.
10,085,517 B2 10/2018 Beers et al.
10,092,065 B2 10/2018 Rushbrook et al.
10,102,722 B2 10/2018 Levesque et al.
10,104,937 B2 10/2018 Beers et al.
10,111,496 B2 10/2018 Schneider et al.
10,201,212 B2 2/2019 Beers et al.
10,231,505 B2 3/2019 Beers et al.
10,238,180 B2 3/2019 Beers et al.
10,441,020 B1 10/2019 Andon et al.
2003/0009913 A1 1/2003 Potter et al.
2003/0150135 A1 8/2003 Liu
2004/0177531 A1 9/2004 DiBenedetto et al.
2005/0183292 A1 8/2005 DiBenedetto et al.
2005/0198867 A1 9/2005 Labbe
2006/0000116 A1 1/2006 Brewer
2007/0000154 A1 1/2007 DiBenedetto et al.
2007/0006489 A1 1/2007 Case et al.
2007/0129907 A1 6/2007 Demon
2007/0164521 A1 7/2007 Robinson
2007/0180730 A1 * 8/2007 Greene ..... B29D 35/146 36/3 R
2007/0260421 A1 11/2007 Berner et al.
2007/0271817 A1 11/2007 Ellis
2008/0066272 A1 3/2008 Hammerslag et al.
2008/0301919 A1 12/2008 Ussher
2009/0184189 A1 7/2009 Soderberg et al.
2009/0193689 A1 8/2009 Galica et al.
2009/0272007 A1 11/2009 Beers et al.
2009/0272013 A1 11/2009 Beers et al.
2010/0063778 A1 3/2010 Schrock et al.
2010/0063779 A1 3/2010 Schrock et al.
2010/0139057 A1 6/2010 Soderberg et al.
2010/0289971 A1 11/2010 Odland et al.
2010/0299959 A1 * 12/2010 Hammerslag ..... A43C 11/16 36/50.5
2011/0025704 A1 2/2011 Odland et al.
2011/0175744 A1 7/2011 Englert et al.
2011/0225843 A1 9/2011 Kerns et al.
2011/0232134 A1 9/2011 Radl et al.
2011/0266384 A1 11/2011 Goodman et al.
2012/0000091 A1 1/2012 Cotterman et al.
2012/0004587 A1 1/2012 Nickel et al.
2012/0124500 A1 5/2012 Hunter
2012/0185801 A1 7/2012 Madonna et al.
2013/0092780 A1 4/2013 Soderberg et al.
2013/0104429 A1 5/2013 Torres

(56) References Cited

U.S. PATENT DOCUMENTS

| | | | | |
|---|---|---|---|---|
| 2013/0213147 | A1 | 8/2013 | Rice et al. | |
| 2013/0312293 | A1* | 11/2013 | Gerber | A43B 23/028 36/34 R |
| 2014/0068838 | A1 | 3/2014 | Beers et al. | |
| 2014/0070042 | A1 | 3/2014 | Beers et al. | |
| 2014/0082963 | A1 | 3/2014 | Beers | |
| 2014/0257156 | A1 | 9/2014 | Capra et al. | |
| 2015/0185764 | A1 | 7/2015 | Magi | |
| 2015/0289594 | A1* | 10/2015 | Rushbrook | A43B 17/00 12/142 T |
| 2015/0359296 | A1* | 12/2015 | Gulla | A43C 11/165 36/109 |
| 2016/0027297 | A1 | 1/2016 | Wu et al. | |
| 2016/0157561 | A1 | 6/2016 | Schum et al. | |
| 2016/0256349 | A1 | 9/2016 | Mayer et al. | |
| 2016/0262485 | A1 | 9/2016 | Walker | |
| 2016/0345654 | A1 | 12/2016 | Beers et al. | |
| 2016/0345679 | A1 | 12/2016 | Beers et al. | |
| 2016/0345681 | A1 | 12/2016 | Pheil et al. | |
| 2016/0360828 | A1 | 12/2016 | Guyan | |
| 2017/0035151 | A1 | 2/2017 | Peyton et al. | |
| 2017/0065027 | A1* | 3/2017 | Hyde | A43C 5/00 |
| 2017/0150773 | A1 | 6/2017 | Beers | |
| 2017/0215524 | A1 | 8/2017 | Rushbrook et al. | |
| 2017/0265572 | A1 | 9/2017 | Beers et al. | |
| 2017/0265573 | A1 | 9/2017 | Beers et al. | |
| 2017/0265574 | A1 | 9/2017 | Beers et al. | |
| 2017/0265575 | A1 | 9/2017 | Beers et al. | |
| 2017/0265576 | A1 | 9/2017 | Beers et al. | |
| 2017/0265577 | A1 | 9/2017 | Schneider | |
| 2017/0265578 | A1 | 9/2017 | Schneider | |
| 2017/0265579 | A1 | 9/2017 | Schneider et al. | |
| 2017/0265580 | A1 | 9/2017 | Schneider et al. | |
| 2017/0265581 | A1 | 9/2017 | Chang | |
| 2017/0265582 | A1 | 9/2017 | Walker et al. | |
| 2017/0265583 | A1 | 9/2017 | Schneider et al. | |
| 2017/0265584 | A1 | 9/2017 | Walker et al. | |
| 2017/0265585 | A1 | 9/2017 | Orand | |
| 2017/0265586 | A1 | 9/2017 | Schneider et al. | |
| 2017/0265587 | A1 | 9/2017 | Walker et al. | |
| 2017/0265588 | A1 | 9/2017 | Walker et al. | |
| 2017/0265589 | A1 | 9/2017 | Walker et al. | |
| 2017/0265591 | A1 | 9/2017 | Schneider | |
| 2017/0265594 | A1 | 9/2017 | Walker et al. | |
| 2017/0267485 | A1 | 9/2017 | Schneider et al. | |
| 2017/0272008 | A1 | 9/2017 | Schneider | |
| 2017/0295889 | A1 | 10/2017 | Beers | |
| 2017/0303643 | A1 | 10/2017 | Converse et al. | |
| 2017/0312161 | A1 | 11/2017 | Johnson et al. | |
| 2017/0318908 | A1 | 11/2017 | Wyatt et al. | |
| 2017/0332734 | A1 | 11/2017 | Orand | |
| 2017/0332735 | A1 | 11/2017 | Orand et al. | |
| 2017/0340049 | A1 | 11/2017 | Rice et al. | |
| 2018/0020764 | A1 | 1/2018 | Walker | |
| 2018/0035760 | A1 | 2/2018 | Bock | |
| 2018/0110288 | A1 | 4/2018 | Hatfield et al. | |
| 2018/0110294 | A1 | 4/2018 | Schneider et al. | |
| 2018/0110298 | A1 | 4/2018 | Schneider et al. | |
| 2018/0116326 | A1 | 5/2018 | Beers et al. | |
| 2018/0125168 | A1 | 5/2018 | Beers et al. | |
| 2018/0153260 | A1 | 6/2018 | Beers | |
| 2018/0153263 | A1 | 6/2018 | Beers et al. | |
| 2018/0199674 | A1 | 7/2018 | Walker et al. | |
| 2018/0219403 | A1 | 8/2018 | Schneider | |
| 2018/0228250 | A1 | 8/2018 | Beers et al. | |
| 2018/0263340 | A1 | 9/2018 | Schneider et al. | |
| 2018/0289110 | A1 | 10/2018 | Bock et al. | |
| 2018/0310644 | A1 | 11/2018 | Poupyrev et al. | |
| 2018/0310659 | A1 | 11/2018 | Poupyrev et al. | |
| 2018/0310670 | A1 | 11/2018 | Rovekamp, Jr. et al. | |
| 2018/0317609 | A1 | 11/2018 | Beers et al. | |
| 2018/0343977 | A1 | 12/2018 | Riccomini et al. | |
| 2018/0343978 | A1 | 12/2018 | Stillman et al. | |
| 2018/0368526 | A1 | 12/2018 | Bock et al. | |
| 2018/0368528 | A1 | 12/2018 | Beers et al. | |
| 2019/0246745 | A1 | 8/2019 | Bock et al. | |
| 2019/0246746 | A1 | 8/2019 | Bock et al. | |
| 2020/0205512 | A1* | 7/2020 | Blanche | A43B 3/246 |

FOREIGN PATENT DOCUMENTS

| | | | |
|---|---|---|---|
| CN | 201222723 | Y | 4/2009 |
| CN | 102058197 | A | 5/2011 |
| CN | 202907266 | U | 4/2013 |
| CN | 104585975 | A | 5/2015 |
| CN | 104822284 | A | 8/2015 |
| CN | 105278768 | A | 1/2016 |
| DE | 29701491 | U1 | 5/1998 |
| DE | 29817003 | U1 | 3/1999 |
| DE | 19833801 | A1 | 2/2000 |
| DE | 102005014709 | A1 | 10/2006 |
| DE | 102005036013 | A1 | 2/2007 |
| DE | 102005052903 | A1 | 5/2007 |
| EP | 0614624 | A1 | 9/1994 |
| EP | 2871994 | A1 | 5/2015 |
| EP | 3046434 | A1 | 7/2016 |
| FR | 2924577 | A1 | 6/2009 |
| GB | 2449722 | A | 12/2008 |
| JP | 3005659 | U | 1/1995 |
| JP | 3195320 | B2 | 8/2001 |
| JP | 2004267784 | A | 9/2004 |
| JP | 2004275201 | A | 10/2004 |
| JP | 2009011460 | A | 1/2009 |
| JP | 2011519611 | A | 7/2011 |
| JP | 5486203 | B2 | 5/2014 |
| JP | 2016530058 | A | 9/2016 |
| KR | 100398822 | B1 | 9/2003 |
| KR | 20050122149 | A | 12/2005 |
| WO | 9811797 | A1 | 3/1998 |
| WO | 2008033963 | A2 | 3/2008 |
| WO | 2009134858 | A1 | 11/2009 |
| WO | 2012109244 | A1 | 8/2012 |
| WO | 2014036374 | A1 | 3/2014 |
| WO | 2014082652 | A1 | 6/2014 |
| WO | 2015014374 | A1 | 2/2015 |
| WO | 2015042216 | A1 | 3/2015 |
| WO | 2015045598 | A1 | 4/2015 |
| WO | 2015056633 | A1 | 4/2015 |
| WO | 2015160406 | A1 | 10/2015 |
| WO | 2015160768 | A1 | 10/2015 |
| WO | 2015160790 | A1 | 10/2015 |
| WO | 2015163982 | A1 | 10/2015 |
| WO | 2016057697 | A1 | 4/2016 |
| WO | 2016191115 | A1 | 12/2016 |
| WO | 2016191117 | A1 | 12/2016 |
| WO | 2016191123 | A1 | 12/2016 |
| WO | 2016195957 | A1 | 12/2016 |
| WO | 2016195965 | A1 | 12/2016 |
| WO | 2017059876 | A1 | 4/2017 |
| WO | 2017092775 | A1 | 6/2017 |
| WO | 2017095945 | A1 | 6/2017 |
| WO | 2017158410 | A1 | 9/2017 |
| WO | 2017160534 | A2 | 9/2017 |
| WO | 2017160536 | A2 | 9/2017 |
| WO | 2017160558 | A2 | 9/2017 |
| WO | 2017160561 | A2 | 9/2017 |
| WO | 2017160563 | A2 | 9/2017 |
| WO | 2017160657 | A2 | 9/2017 |
| WO | 2017160708 | A2 | 9/2017 |
| WO | 2017160865 | A1 | 9/2017 |
| WO | 2017160866 | A1 | 9/2017 |
| WO | 2017160881 | A1 | 9/2017 |
| WO | 2017160969 | A1 | 9/2017 |
| WO | 2017161000 | A2 | 9/2017 |
| WO | 2017161014 | A1 | 9/2017 |
| WO | 2017161037 | A1 | 9/2017 |
| WO | 2017161044 | A1 | 9/2017 |
| WO | 2017164612 | A1 | 9/2017 |
| WO | 2017185160 | A1 | 11/2017 |
| WO | 2017189926 | A1 | 11/2017 |
| WO | 2017197627 | A1 | 11/2017 |
| WO | 2017091769 | A8 | 1/2018 |
| WO | 2018028380 | A1 | 2/2018 |
| WO | 2018028381 | A1 | 2/2018 |

(56) References Cited

FOREIGN PATENT DOCUMENTS

| | | | |
|---|---|---|---|
| WO | 2018081260 | A1 | 5/2018 |
| WO | 2018094156 | A1 | 5/2018 |
| WO | 2018095500 | A1 | 5/2018 |
| WO | 2018095501 | A1 | 5/2018 |
| WO | 2018120085 | A1 | 7/2018 |
| WO | 2017161000 | A3 | 8/2018 |
| WO | 2018170148 | A2 | 9/2018 |
| WO | 2018170148 | A3 | 11/2018 |
| WO | 2018222805 | A2 | 12/2018 |
| WO | 2018222807 | A2 | 12/2018 |
| WO | 2018222836 | A2 | 12/2018 |

OTHER PUBLICATIONS

Notice of Reasons for Refusal issued in Japanese Application No. 2018-524270, dated Dec. 3, 2019, 9 pages.
Search Report by Registered Search Organization issued in Japanese Application No. 2018-524270, dated Nov. 27, 2019, 128 pages.
International Search Report and Written Opinion of International Application No. PCT/IB2020/053777, dated Jun. 18, 2020, 12 pages.
International Search Report and Written Opinion of International Application No. PCT/IB2020/053778, dated Jun. 18, 2020, 14 pages.
The First Office Action issued in corresponding Chinese Application No. 201680091000.4, dated Jun. 5, 2020, 19 pages.
First Office Action from corresponding Chinese Patent Application No. 201680091016.5, dated Oct. 22, 2020 (15 pages).
Invitation to Pay Additional Fees and Communication Relating to Results of Partial International Search Report from corresponding PCT Application No. PCT/IB2020/058424 dated Dec. 8, 2020 (12 pages).
Written Opinion of International Application No. PCT/EP2016/001968, mailed Jul. 31, 2017, 6 pages.
International Preliminary Report on Patentability (Form IPEA/409) of International Application No. PCT/EP2016/001968, mailed Jan. 9, 2019, 31 pages.
Written Opinion of International Application No. PCT/EP2016/001967, mailed Jul. 26, 2017, 6 pages.
International Preliminary Report on Patentability (Form IPEA/409) of International Application No. PCT/EP2016/001967, mailed Jan. 4, 2019, 23 pages.
The First Office Action issued in corresponding Chinese Application No. 201580084987.2, dated May 6, 2020, 25 pages.
Liszewski, Andrew "A Self-Adjusting Smart Belt: Yes, It's Come to This" Jan. 4, 2015, XP055386586 Retrieved from the Internet: URL: https://gizmodo.com/the-only-gadget-1677432880 [retrieved on May 13, 2019].
International search report issued in corresponding International Application No. PCT/EP2015/001963, dated Aug. 9, 2016, 5 pages.
International search report issued in corresponding International Application No. PCT/EP2016/001967, dated Jul. 26, 2017, 7 pages.
International search report issued in corresponding International Application No. PCT/EP2016/001968, dated Jul. 31, 2017, 6 pages.

* cited by examiner

OR

NEUTRAL ACTIVE NEUTRAL ACTIVE NEUTRAL

ARTICLE OF FOOTWEAR HAVING ADAPTIVE ACTUATION MECHANICS

CROSS REFERENCE TO RELATED APPLICATIONS

This application claims priority to U.S. Provisional Application Ser. No. 62/923,919, filed on Oct. 21, 2019, the contents of which is incorporated by reference herein in its entirety and is to be considered a part of this application.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including adaptive actuation mechanics for automatically adjusting regions of the article of footwear in response to a wearer's movements.

2. Description of the Background

Many conventional shoes or articles of footwear generally comprise an upper and a sole attached to the upper. Conventional shoes further include an internal space, i.e., a void or cavity, which is created by interior surfaces of the upper and sole, that receives a foot of a user before securing the shoe to the foot. The sole is attached to a lower surface of the upper and is positioned between the upper and the ground. As a result, the sole typically provides stability and cushioning to the user when the shoe is being worn and/or is in use. In some instances, the sole may include multiple components, such as an outsole, a midsole, and an insole. The outsole may provide traction to a bottom surface of the sole, and the midsole may be attached to an inner surface of the outsole, and may provide cushioning and/or added stability to the sole. For example, a sole may include a particular foam material that may increase stability at one or more desired locations along the sole, or a foam material that may reduce stress or impact energy on the foot and/or leg when a user is running, walking, or engaged in another activity.

The upper generally extends upward from the sole and defines an interior cavity that completely or partially encases a foot. In most cases, an upper extends over instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, the tongue being provided to allow for adjustment of shoe tightness. The tongue may further be manipulated by a user to permit entry and/or exit of a foot from the internal space or cavity. In addition, the lacing system may allow a user to adjust certain dimensions of the upper and/or the sole, thereby allowing the upper to accommodate a wide variety of foot types having varying sizes and shapes.

The upper may comprise a wide variety of materials, which may be chosen based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

The materials distributed among various portions of the upper generally provide certain support features (e.g., rigidity, flexibility, stretch-resistance, etc.) regardless of a user's foot and/or ankle movement. Further, lacing systems are generally meant to maintain the upper in a specific orientation with a desired tightness once laced. However, it may be desirable to utilize a footwear system that dynamically adapts to a wearer. For example, it may be desirable to utilize a system that dynamically adjusts the upper based on, for example, a user's foot and/or ankle movement. It may also be desirable to include a system configured to utilize and redistribute forces exerted by a user on certain areas of the sole and/or upper to other areas of the upper to further support the user's movements. Further, it may be desirable to include a system that automatically adjusts upper tightness around regions of the foot and/or ankle based on the user's foot and/or ankle movement in order to dynamically support the user during certain activities.

Therefore, articles of footwear having systems with passive or active actuation mechanics capable of dynamic upper adjustments based on user movement may be desired.

SUMMARY

An article of footwear, as described herein, may have various configurations. In some embodiments, an article of footwear includes a sole structure comprising a midsole, an upper attached to the sole structure, and an adaptive actuation system coupled to the upper. The upper defines a forefoot region, a midfoot region, and a heel region of the article of footwear, and further defining a foot region and ankle region of the article of footwear. The adaptive actuation system comprises a cable configured to compress a portion of the upper in response to movement of at least one of the sole structure or the upper by the user.

In some embodiments, the cable is wrapped around the ankle region and configured to compress the ankle region. In some embodiments, the adaptive actuation system is a preload system comprising the cable and a plurality of cable guides configured to couple the cable to the upper. Further, the cable is coupled to the upper at a first anchor point adjacent a front end of the upper in the forefoot region, and is looped from the first anchor point toward a rear end of the upper, wrapped around the ankle region back toward the rear end of the upper, and back to the first anchor point. Tightening of the cable causes the ankle region to be compressed.

In some embodiments, the preload system further comprises a disc configured to be coupled to the upper and receive the cable, wherein the disc can be manipulated to one of tighten or loosen the cable. In some embodiments, flattening of the midsole causes the cable to tighten and curving of the midsole causes the cable to loosen. In some embodiments, the cable is coupled to one of the upper or the sole structure at a second anchor point adjacent a widest portion of the sole structure at a lateral side thereof, and is coupled to one of the upper or the sole structure at a third anchor point adjacent the widest portion of the sole structure at a medial side thereof.

In some embodiments, the article of footwear further comprises a links system configured to distribute compressive forces from the cable around the ankle region. The links system comprises a plurality of links coupled to the upper and spaced around the ankle region, and the cable is routed through an aperture of each of the plurality of links. In some embodiments, the plurality of links include a plurality of moveable links and an anchor link. The plurality of moveable links each include a first aperture having a first diameter causing a first friction between an inner surface of the first aperture and the cable, and the anchor link includes a second aperture having a second diameter causing a second friction, less than the first friction, between an inner surface of the second aperture and the cable.

In some embodiments, the adaptive actuation system is an active response system comprising a motor coupled to the cable and configured to tighten the cable, a controller configured to actuate the motor, and a sensor in communication with the controller. Tightening of the cable causes the ankle region to be compressed. In some embodiments, the controller is configured to obtain sensed measurements from the sensor indicative of movement of the user, and actuate the motor based on the sensed measurements. In some embodiments, the controller is embedded within the midsole. In some embodiments, the upper includes a heel counter positioned in the heel region at a rear end thereof, and the active response system includes an ankle cup coupled to the heel counter and housing the controller and the motor.

In some embodiments, an article of footwear includes a sole structure comprising a midsole, an upper attached to the sole structure, and an active response system. The upper defines a forefoot region, a midfoot region, and a heel region of the article of footwear, and further defines a foot region and ankle region of the article of footwear. The active response system is configured to compress a portion of the upper in response to movement of at least one of the sole structure or the upper by the user. The active response system includes a cable configured to wrap around a portion of the upper, a motor coupled to the cable and configured to adjust a tension of the cable, a sensor configured to sense one of movement and acceleration, and a controller configured to actuate the motor in response to input from the sensor.

In some embodiments, the upper includes a heel counter positioned in the heel region at a rear end thereof, and the active response system includes an ankle cup coupled to the heel counter and housing the motor and the controller. In some embodiments, the ankle cup is removably coupled to the heel counter. In some embodiments, the ankle cup includes a housing, and the active response system further includes a button in communication with the controller and accessible by the user from outside the housing. The controller is configured to actuate the motor in response to user feedback received via the button.

In some embodiments, the active response system includes an ankle strap configured to wrap around an ankle of the user, and the cable is coupled to the ankle strap. In some embodiments, the controller is configured to communicate with a remote electronic device.

In some embodiments, a method of dynamically adjusting a fit of an article of footwear to a foot of a user is provided. The method includes providing an active response system coupled to the article of footwear and including a cable configured to adjust a fit of a portion of an upper of the article of footwear based on a tension of the cable, a motor coupled to the cable and configured to adjust the tension of the cable, and a sensor configured to sense one of movement and acceleration. The method also includes receiving input from the sensor, determining movements of the user based on the input of from the sensor, and classifying the movements as an activity being performed by the user. The method further includes determining an optimal fit state of the article of footwear to the foot of the user based on the activity, and placing the article of footwear in the optimal fit state by actuating the motor to adjust the tension of the cable.

In some embodiments of the above method, determining movements of the user and classifying the movements as an activity each include using settings calibrated to the user.

Other aspects of the articles of footwear described herein, including features and advantages thereof, will become apparent to one of ordinary skill in the art upon examination of the figures and detailed description herein. Therefore, all such aspects of the articles of footwear are intended to be included in the detailed description and this summary.

BRIEF DESCRIPTION OF THE DRAWINGS

FIGS. 9A-9C are side views of user movements in a shoe comprising a preload system, wherein FIG. 9A is a side view of the user movement causing the shoe to be in a first preload stage, FIG. 9B is a side view of the user movement causing the shoe to be in a second preload stage, and FIG. 9C is a side view of the user movement causing the shoe to be in a third preload stage;

FIG. 10A is a side view of the user at rest, FIG. 10B is a side view of the user taking off, FIG. 10C is a side view of the user in the air, FIG. 10D is a side view of the user in an initial landing, FIG. 10E is a side view of the user completing the landing, and FIG. 10F is a side view of the user again at rest;

DETAILED DESCRIPTION OF THE DRAWINGS

Figure 1:
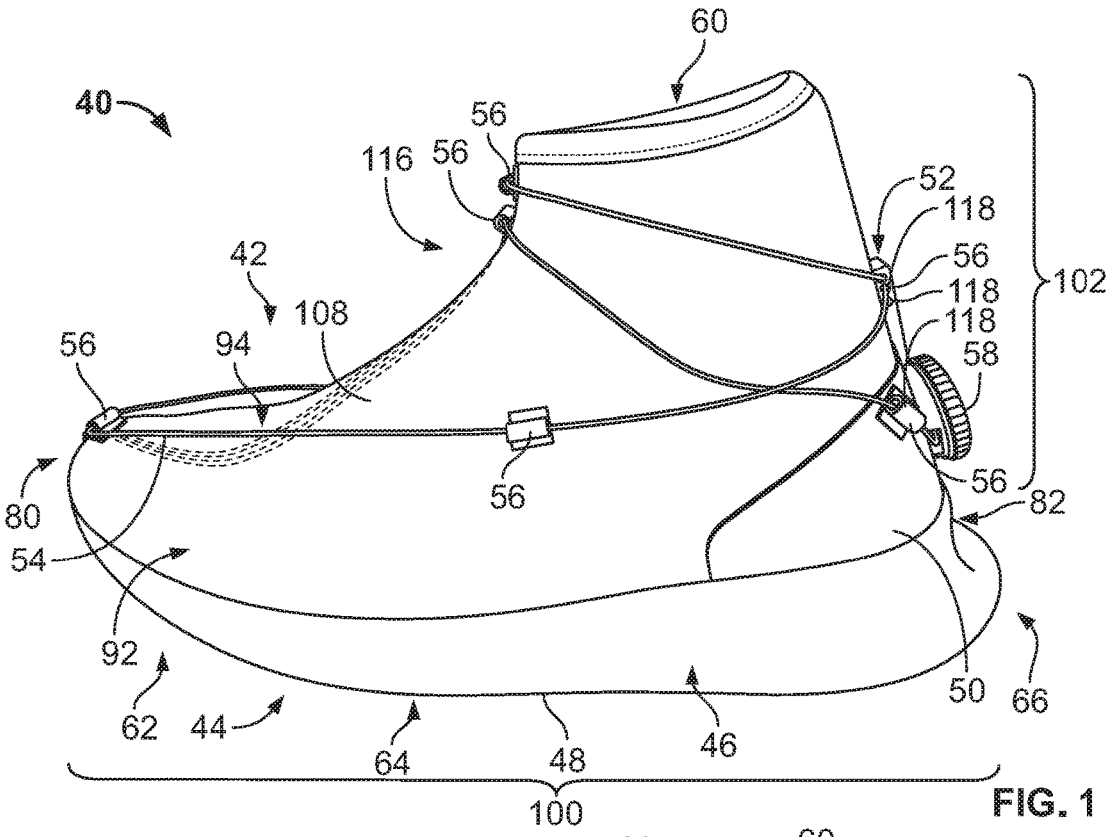
FIG. 1 is a lateral view of a left shoe comprising a preload system having a first configuration.

The following discussion and accompanying figures disclose various embodiments or configurations of a shoe and an automatic lacing system for the shoe. Although embodiments are disclosed with reference to a sports shoe, such as a running shoe, tennis shoe, basketball shoe, etc., concepts associated with embodiments of the shoe may be applied to a wide range of footwear and footwear styles, including basketball shoes, cross-training shoes, football shoes, golf shoes, hiking shoes, hiking boots, ski and snowboard boots, soccer shoes and cleats, walking shoes, and track cleats, for example. Concepts of the shoe or the automatic lacing system may also be applied to articles of footwear that are considered non-athletic, including dress shoes, sandals, loafers, slippers, and heels. In addition to footwear, particular concepts described herein, such as the automatic lacing concept, may also be applied and incorporated in other types of articles, including apparel or other athletic equipment, such as helmets, padding or protective pads, shin guards, and gloves. Even further, particular concepts described herein may be incorporated in cushions, backpacks, suitcases, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The term "swipe" or variations thereof used herein refers to an act or instance of moving one's finger(s) across a panel or touchscreen to activate a function. A "swipe" involves touching a panel or touchscreen, moving one's finger along the panel or touchscreen in a first direction, and subsequently removing contact of one's finger with the panel or touchscreen.

The present disclosure is directed to an article of footwear and/or specific components of the article of footwear, such as an upper and/or a sole or sole structure, and an adaptive actuation system in the form of a preload system, a lateral activation system, a hybrid preload system and lateral activation system, and/or an active response system. The adaptive actuation system can generally include a cable coupled to or otherwise associated with the upper and configured to be tightened in order to compress a region of the upper in response to movements of a user wearing the article of footwear. For example, the preload system may further include a "preloaded" midsole coupled to the cable, that causes the cable to tighten, and therefore compress a region of the upper, when user movement actuates the midsole in a particular manner. As such, the preload system diverts forces exerted onto the article of footwear by the user during movement to other regions of the upper for added support in those other regions. The lateral activation system may include the cable coupled to a lateral and medial side of the upper and adapted to compress a forefoot region of the upper. The active response system may further include a controller configured to actuate one or more motors that tighten the cable(s) based on input from one or more sensors configured to sense movement of the article of footwear. As such, the active response system provides a motorized article of footwear that provides support to certain regions of the upper based on a user's activities, characterized by the user's particular movements. Accordingly, the articles of footwear of some embodiments described herein can provide support to a user wearing the article of footwear that is both active and adaptive to the user's movements, thus increasing stability, enhancing performance, and helping reduce injury.

FIG. 1 depicts an article of footwear 40, configured as a left shoe, with an upper 42, a sole structure 44 having at least a midsole 46 and an outsole 48, a heel counter 50, and an adaptive actuation system in the form of a preload system 52. As will be further discussed herein, the upper 42 is attached to the sole structure 44 such that the components define an interior cavity 60 into which a foot of a user may be inserted. The preload system 52 includes a tension cable 54 configured to wrap around the upper 42, a plurality of cable guides 56 configured to receive the tension cable 54, and a disc 58 configured to receive and selectively tighten or loosen the tension cable 54. The shoe 40 may also include additional components not specifically addressed herein.

Figure 2:
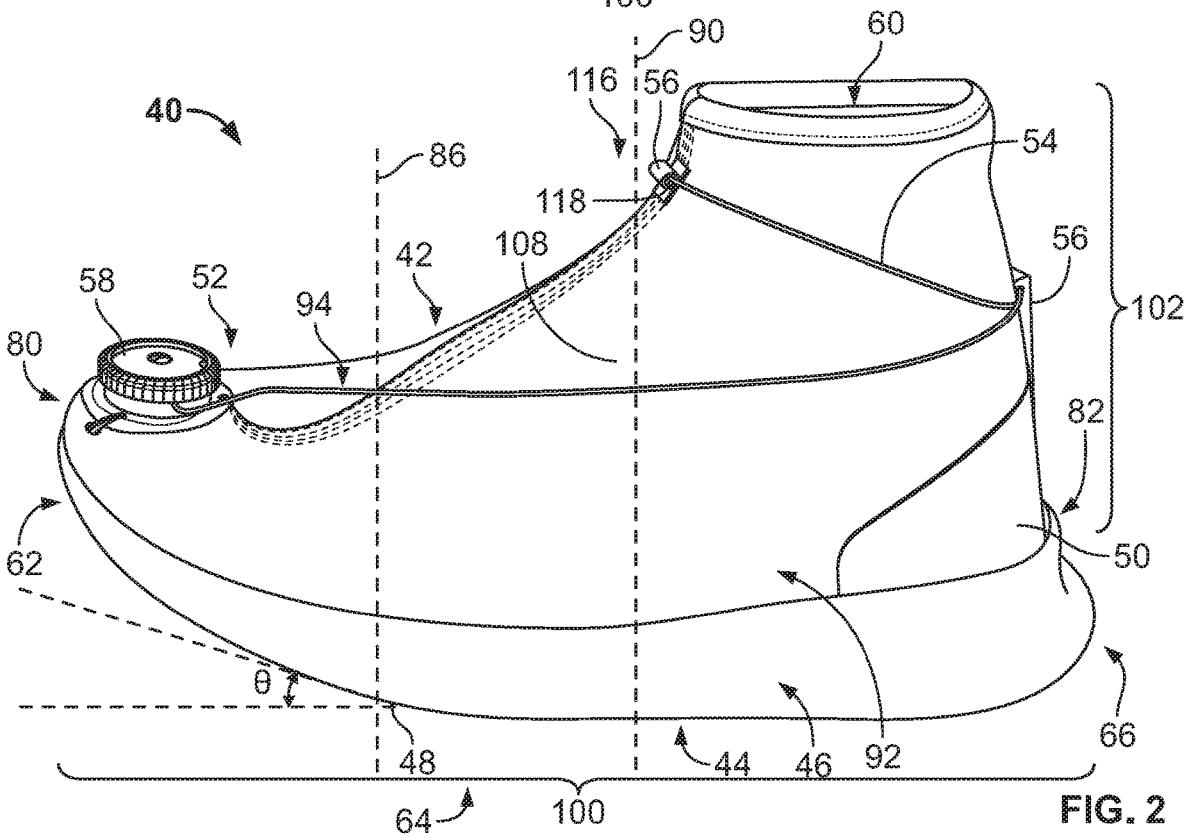
FIG. 2 is a lateral view of a left shoe comprising a preload system having a second configuration.
Figure 3:
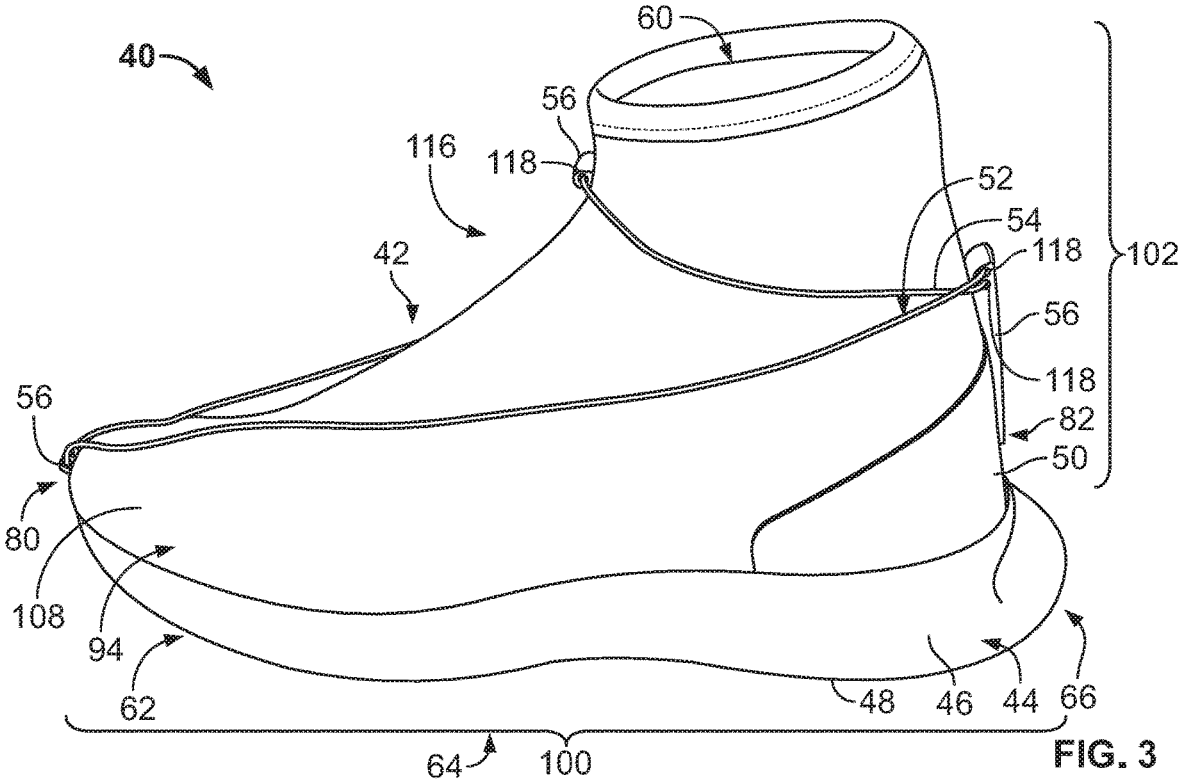
FIG. 3 is medial view of a right shoe comprising a preload system having a third configuration.
Figure 4:
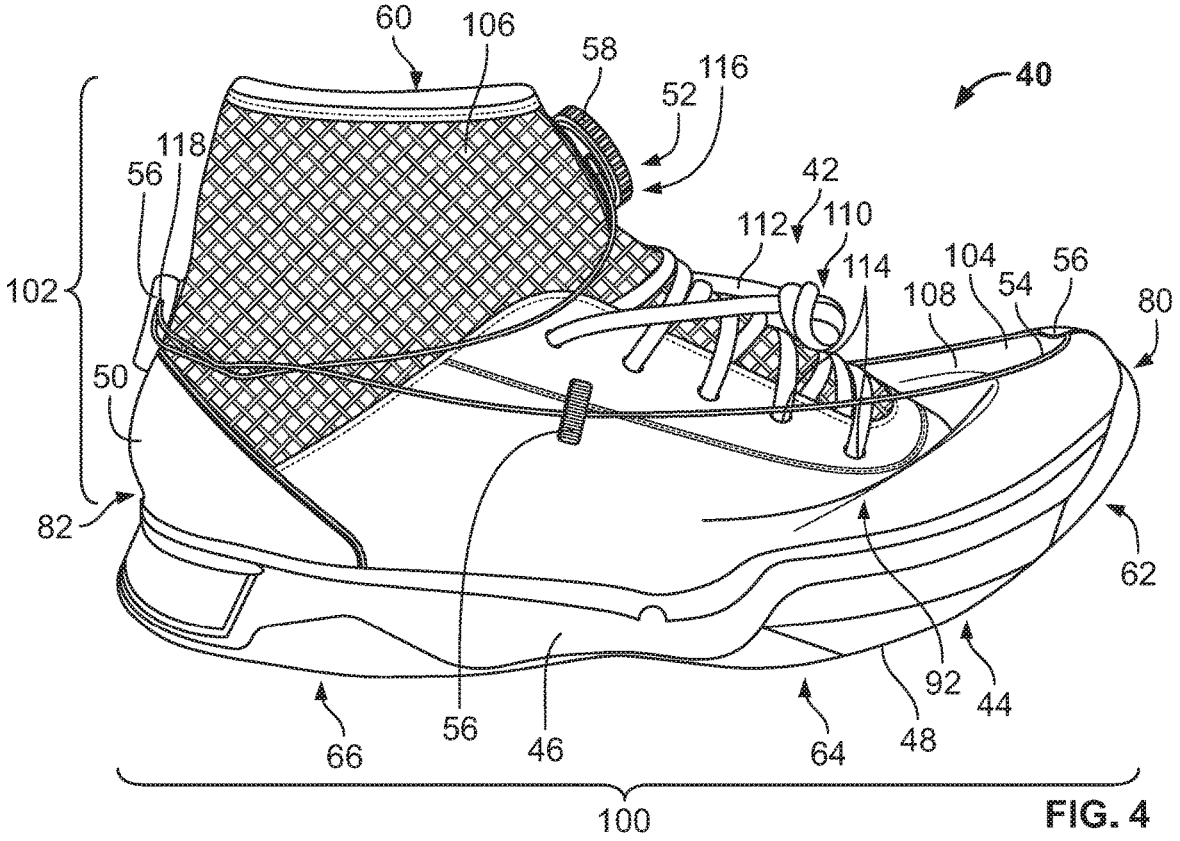
FIG. 4 is a lateral view of a right shoe comprising a preload system having a fourth configuration.

Furthermore, FIGS. 2-4 further depict an article of footwear 40 having a preload system 52 with various configurations.

As discussed in greater detail hereinafter below, the article of footwear 40 and, in particular, the preload system 52, is intended to actively respond to a user's movements by diverting forces exerted by the user to specific regions of the article of footwear 40 for added support. More specifically, the preload system 52 "preloads" the midsole 46 of the article of footwear 40 such that forces on the midsole 46 generated by the user flattening their foot translate to tightening of the tension cable 54 around the user's ankle. These and other features will be described in greater detail below.

Though the article of footwear 40 is depicted in FIG. 1 as a single, left shoe 40, the article of footwear 40 may be part of a pair of articles of footwear 40 (e.g., a footwear assembly) comprising a first or left shoe (shown in FIGS. 1 and 2) and a second or right shoe (shown in FIGS. 3 and 4). The left shoe and the right shoe may be similar in all material aspects, except that the left shoe and the right shoe are sized and shaped to receive a left foot and a right foot of a user, respectively. Thus, for ease of disclosure, a single shoe, or article of footwear 40, will be referenced to describe aspects of the disclosure. In some figures, the article of footwear 40 is depicted as a right shoe, and in some figures the article of footwear 40 is depicted as a left shoe. The disclosure herein with reference to the article of footwear 40 is applicable to both the left shoe and the right shoe. In some embodiments, there may be differences between the left shoe and the right shoe other than the left/right configuration, or the left shoe may include one or more additional elements that the right shoe does not include, or vice versa.

Figure 5:
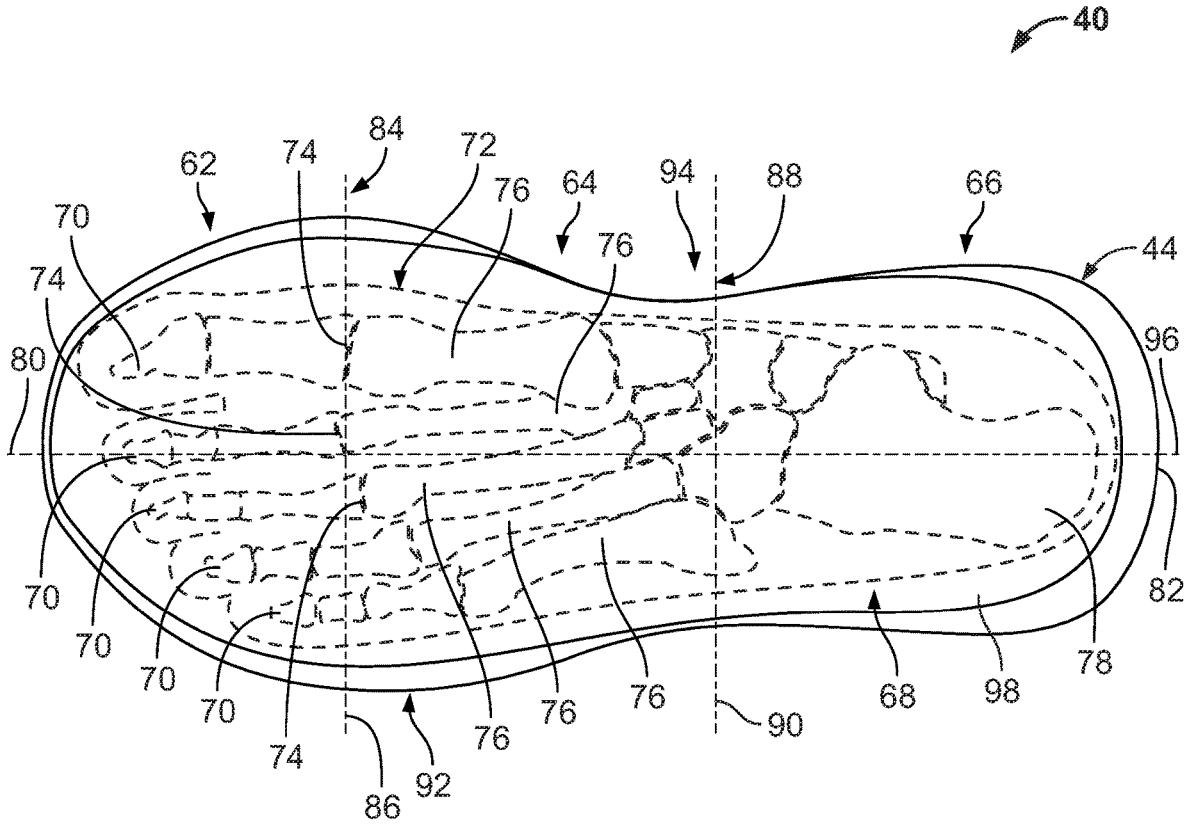
FIG. 5 is an underside view of an article of footwear, with portions of an outsole and midsole removed and a user's skeletal foot structure overlaid thereon.

Unless otherwise specified, with reference to FIG. 5, the article of footwear 40 may be defined by a forefoot region 62, a midfoot region 64, and a heel region 66. The forefoot region 62 may generally correspond with portions of the article of footwear 40 that encase portions of a foot 68 that include the toes or phalanges 70, the ball of the foot 72, and one or more of the joints 74 that connect the metatarsals 76 of the foot 68 with the toes or phalanges 70. The midfoot region 64 is proximate and adjoins the forefoot region 62. The midfoot region 64 generally corresponds with portions of the article of footwear 40 that encase an arch of the foot 68, along with a bridge of the foot 68. The heel region 66 is proximate to the midfoot region 64 and adjoins the midfoot region 64. The heel region 66 generally corresponds with portions of the article of footwear 40 that encase rear portions of the foot 68, including the heel or calcaneus bone 78, the ankle (not shown), and/or the Achilles tendon (not shown).

Still referring to FIG. 5, the forefoot region 62, the midfoot region 64, and the heel region 66 collectively span an entire length of the article of footwear 40, from a front end 80 (e.g., adjacent the toes 70 of the user) to a rear end 82 (e.g., adjacent the heel of the user). The forefoot region 62 extends from the front end 80 to a widest portion 84 of the article of footwear 40. The widest portion 84 may be defined or measured along a first line 86, as shown in FIG. 5. The midfoot region 64 extends from the widest portion 84 to a thinnest portion 88 of the article of footwear 40 (which may be defined or measured along a second line 90, as shown in FIG. 5). The heel region 66 extends from the thinnest portion 88 to the rear end 82 of the article of footwear 40.

Referring still to FIG. 5, the article of footwear 40 also defines a lateral side 92 and a medial side 94, the lateral side 92 being shown in FIGS. 1, 2, and 4 and the medial side 94 being shown in FIG. 3. When a user is wearing the article of footwear 40, the lateral side 92 corresponds with an outside-facing portion of the article of footwear 40 while the medial side 94 corresponds with an inside-facing portion of the article of footwear 40. As such, the left shoe and the right shoe have opposing lateral sides 92 and medial sides 94, such that the medial sides 94 are closest to one another when a user is wearing the shoes 40, while the lateral sides 92 are defined as the sides that are farthest from one another while the shoes 40 are being worn.

Generally, the medial side 94 and the lateral side 92 adjoin one another along a longitudinal central plane or axis 96 of the article of footwear 40. As such, the longitudinal central plane or axis 96 may demarcate a central, intermediate axis between the medial side 94 and the lateral side 92. Put differently, the longitudinal plane or axis 96 may extend between the rear end 82 of the article of footwear 40 and the front end 80 of the article of footwear 40 and may continuously define a middle of an insole 98, the sole structure 44, and/or the upper 42 of the article of footwear 40, i.e., the longitudinal plane or axis 96 is a straight axis extending from the rear end 82 at the heel region 66 to the front end 80 at the forefoot region 62. Furthermore, the longitudinal plane or axis 96 may be perpendicular to the first line 86 and the second line 90.

Still referring to FIG. 5, the medial side 94 begins at the front end 80 at the longitudinal, central axis 96 and bows outward along an inner side of the article of footwear 40 along the forefoot region 62 toward the midfoot region 64. The medial side 94 reaches the first line 86, at which point the medial side 94 enters into the midfoot region 64 (i.e., upon crossing the first line 86), and bows inward, toward the central, longitudinal axis 96. That is, the medial side 94 extends from the first line 86, e.g., the widest portion 84 of the shoe 40, toward the second line 90, e.g., the thinnest portion 88 of the shoe 40. Once reaching the second line 90, at which point the medial side 94 extends into the heel region 66 (i.e., upon crossing the second line 90), the medial side 94 bows outward, away from the longitudinal, central axis 96. The medial side 94 then bows back inward toward the rear end 82, and terminates at a point where the medial side 94 meets the longitudinal, central axis 96.

The lateral side 92 also begins at the front end 80 at the longitudinal, central axis 96 and bows outward along an outer side of the article of footwear 40 (i.e., opposite the inner side) along the forefoot region 62 toward the midfoot region 64. The lateral side 92 reaches the first line 86, at which point the lateral side 92 enters into the midfoot region 64 (i.e., upon crossing the first line 86), and bows inward, toward the longitudinal, central axis 96. That is, the lateral side 92 extends from the first line 86, e.g., the widest portion 84, toward the second line 90, e.g., the thinnest portion 88. Once reaching the second line 90, the lateral side 92 extends into the heel region 66 (i.e., upon crossing the second line 90) and bows outward, away from the longitudinal, central axis 96. The lateral side 92 then bows back inward toward the rear end 82, and terminates at a point where the lateral side 92 meets the longitudinal, central axis 96.

Still referring to FIG. 5, the forefoot region 62, the midfoot region 64, the heel region 66, the lateral side 92, and the medial side 94 are intended to define boundaries or areas of the article of footwear 40. To that end, the forefoot region 62, the midfoot region 64, the heel region 66, the lateral side 92, and the medial side 94 generally characterize sections of the article of footwear 40. Certain aspects of the disclosure may refer to portions or elements that are coextensive with one or more of the forefoot region 62, the midfoot region 64, the heel region 66, the lateral side 92, and/or the medial side 94. Further, both the upper 42 and the sole structure 44 may be characterized as having portions within the forefoot region 62, the midfoot region 64, the heel region 66, and/or along the lateral side 92 and/or the medial side 94. In other words, the upper 42 and the sole structure 44, and/or individual portions of the upper 42 and the sole structure 44, may be disposed within the forefoot region 62, the midfoot region 64, the heel region 66, and/or along the lateral side 92 and/or the medial side 94.

It should be understood that numerous modifications may be apparent to those skilled in the art in view of the foregoing description, and individual components thereof, may be incorporated into numerous articles of footwear. Accordingly, aspects of the article of footwear 40 and components thereof, may be described with reference to general areas or portions of the article of footwear 40, with an understanding the boundaries of the forefoot region 62, the midfoot region 64, the heel region 66, the lateral side 92, and/or the medial side 94 as described herein may vary between articles of footwear. Furthermore, aspects of the article of footwear 40 and individual components thereof, may also be described with reference to exact areas or portions of the article of footwear 40 and the scope of the appended claims herein may incorporate the limitations associated with these boundaries of the forefoot region 62, the midfoot region 64, the heel region 66, the lateral side 92, and/or the medial side 94 discussed herein.

With reference now to the upper 42, as shown in FIGS. 1-4, the upper 42 generally extends upwardly from the sole structure 44 and defines the interior cavity 60 that receives and secures a foot of a user. The upper 42 may be defined by a foot region 100 and an ankle region 102. In general, the foot region 100 extends upwardly from the sole structure 44 and through the forefoot region 62, the midfoot region 64, and the heel region 66. The ankle region 102 is primarily located in the heel region 66; however, in some embodiments, the ankle region 102 may partially extend into the midfoot region 64. Additionally, the ankle region 102 may extend upwardly from the foot region 100 and/or the sole structure 44 and terminate above the user's ankle (e.g., a high-profile or high-top shoe 40), at the ankle (e.g., a mid-profile shoe 40), or below the ankle (e.g., a low-profile or low-top shoe 40). For example, the articles of footwear 40 shown in FIGS. 1-4 may be considered high-top shoes 40 as the ankle region 102 is sized to terminate above a user's ankle.

Many conventional footwear uppers are formed from multiple elements, e.g., textiles, polymer foam, polymer sheets, leather, and/or synthetic leather, which are joined through bonding or stitching at a seam. In some embodiments, the upper 42 of the article of footwear 40 is formed from a knitted structure or knitted components. In various embodiments, a knitted component may incorporate various types of yarn that may provide different properties to an upper. For example, one area of the upper 42 may be formed from a first type of yarn that imparts a first set of properties, and another area of the upper 42 may be formed from a second type of yarn that imparts a second set of properties. Using this configuration, properties of the upper 42 may vary throughout the upper 42 by selecting specific yarns for different areas of the upper 42. For example, as shown in FIG. 4, the upper 42 can include a first material 104 in a first area of the upper 42 (e.g., including portions of the foot region 100) and a second material 106 in a second area of the upper 42 (e.g., including the ankle region 102 and, optionally, portions of the foot region 100). Furthermore, in some embodiments, the properties associated with the upper 42, e.g., a stitch type, a weave type and/or direction, a yarn type, or characteristics associated with different stitch types, weave types, or yarn types, such as elasticity, aesthetic appearance, thickness, air permeability, or scuff-resistance, may be varied.

In some embodiments, the upper 42 may also include additional structural elements. For example, as shown in FIGS. 1-4, the heel counter 50 may be provided at the heel region 66 to provide added support to a heel of a user. For example, the heel counter 50 can extend upward from the sole structure 44 adjacent the rear end 82 to substantially wrap around a user's heel. The heel counter 50 can comprise material(s), such as plastic, that are substantially stiffer than the other material(s) that make up the upper 42 in order to support the heel. Additionally, though not shown in FIGS. 1-4, in some embodiments, the heel counter 50 may be located internal to or embedded within the other material(s) of the upper 42. Furthermore, in some instances, other elements, e.g., plastic material, logos, trademarks, etc., may also be applied and fixed to an exterior surface of the upper 42 using glue or a thermoforming process.

Referring to FIGS. 1-3, the upper 42 comprises a continuous or closed exterior surface 108 adapted to extend across the bridge of a user's foot from the lateral side 92 to the medial side 94 (i.e., crossing the longitudinal axis 96). In this manner, the upper 42 provides a tongueless or sock-fit closure system with a slip-on construction, wherein the material(s) of the upper 42 are configured to hug tightly against the user's foot to secure the article of footwear 40 to the user's foot.

Referring to FIG. 4, in some embodiments, the upper 42 comprises the closed exterior surface 108 as well as a lacing system 110 configured to provide a tie-up closure system for securing the article of footwear 40 to the user's foot. For example, the lacing system 110 can include one or more laces 112 that extend through eyelets 114 or guides in the upper 42 along the medial and lateral sides thereof. The lacing system 110 may allow a user to modify dimensions of the upper 42, e.g., to tighten or loosen portions of the upper 42, around a foot as desired by the user. In some embodiments, the upper 42 can include an interrupted exterior surface 108, with a central gap between the lateral side 92 and the medial side 94 thereof at the bridge or instep of a user's foot. In such embodiments, the upper 42 can further include a tongue that bridges the gap. The tongue may also be disposed below a lacing system 110 between medial and lateral sides of the upper 42 to provide a tie-up closure system for securing the shoe 40 to the user's foot. Further, in some embodiments (e.g., including the closed or interrupted exterior surface 108), the upper 42 can include closure systems with other fastening mechanisms that allow a user to modify dimensions of the upper 42, such as hook and loop fasteners, buckles, zippers, or others. These fastening mechanisms may be located along the bridge or instep of the foot, in place of the lacing system 110, or may be located along other locations of upper 42 such as, but not limited to, the heel region 66 adjacent the rear end 82.

Referring now to the sole structure 44, with reference to FIGS. 1-4, the sole structure 44 is connected or secured to the upper 42 and extends between a foot of a user and the ground when the article of footwear 40 is worn by the user. In some embodiments, the sole structure 44 may include the outsole 48 that provides structural integrity to the sole structure 44, along with providing traction for a user, the midsole 46 that provides a suspension and/or cushioning system, and the insole 98 that provides support for an arch of a user. For example, the outsole 48 may be defined as a portion of the sole structure 44 that at least partially contacts an exterior surface, e.g., the ground, when the article of footwear 40 is worn. The insole 98 may be defined as a portion of the sole structure 44 that at least partially contacts a user's foot when the article of footwear 40 is worn. Finally, the midsole 46 may be defined as at least a portion of the sole structure 52 that extends between and connects the outsole 48 with the insole 98. Furthermore, the outsole 48, the midsole 46, and the insole 98, and/or any components thereof, may include portions within the forefoot region 62, the midfoot region 64, and/or the heel region 66. Further, the outsole 48, the midsole 46, and the insole 98, and/or any components thereof, may include portions on the lateral side 92 and/or the medial side 94. Additionally, in some embodiments, at the forefoot region 62, the outsole 48 may curve around the midsole 46 (which may taper toward the front end 80) to extend upward and contact or nearly contact the upper 42.

Referring to FIGS. 1-4, in some embodiments, the sole structure 44 may remain substantially flat relative to the ground at the midfoot region 64, and may remain substantially flat or slightly curved upward at the heel region 66. The sole structure 44 may also remain substantially flat or curve upward away from the ground at the forefoot region 62. For example, as shown in FIG. 2, the sole structure 44 may curve upward, starting near the first line 86, at an angle θ relative to the ground, though in some embodiments, the curve may start in the midfoot region 64 before the first line 86. This forefoot upward curve may be referred to as a toe spring and can generally facilitate a user's forefoot's ability to roll forward at the end of a stance.

Referring now to the preload system 52, FIGS. 1-4 illustrate various configurations of a preload system 52, which may include the tension cable 54, the plurality of cable guides 56, and/or the disc 58. Generally, the tension cable 54 can be coupled to the upper 42 or the sole structure 44 in the forefoot region 62 (e.g., adjacent the front end 80), extend rearward toward the rear end 82, and wrap around the ankle region 102, for example, forming a loop. The cable guides 56 can be coupled to the upper 42 and/or the sole structure 44 to couple the tension cable 54 to the upper 42 and/or the sole structure 44 in a manner that permits movement of tension cable 54 through the cable guides 56. The disc 58 can receive the tension cable 54 and can be configured to selectively loosen or tighten the tension cable 54 (e.g., lengthen or shorten the tension cable loop, respectively).

Generally, in athletic activities, one significant factor that affects a user's performance is the onset of fatigue. Fatigue can cause slight changes in the user's foot and ankle movements, delayed corrections to such changes, and/or delayed responses for actively engaging the foot and ankle during movement, which can lead to injury. In some embodiments, the preload system 52 can counteract the effects of fatigue and/or delay fatigue by actively responding to the user's movements and adapting to provide support where needed. For example, in some embodiments, the preload system 52 "preloads" the midsole 46 such that the curvature of the midsole, caused by the user's stance or movements, affects the tightening of the tension cable 54 around the user's ankle, as further described herein below.

Referring to FIG. 1, the tension cable 54 can be coupled to the upper 42, for example, via the cable guides 56, at various anchor points along the shoe 40. These anchor points can include at least the front end 80, the rear end 82, and an ankle front 116 of the ankle region 102. Accordingly, a first, or front cable guide 56 can be coupled to the upper 42 and/or the sole structure 44 in the forefoot region 62 at or adjacent the front end 80. A second, or rear cable guide 56 can be coupled to the upper 42 and/or the heel counter 50 in the heel region 66 at or adjacent the rear end 82. A third, or ankle cable guide 56 can be coupled to the upper 42 at the ankle front 116. As shown in FIG. 1, additional cable guides 56 can be coupled to the upper 42 or the heel counter 50 and located at various anchor points along the lateral side 92 and/or the medial side 94 (e.g., side cable guides 56), and/or additionally at the ankle front 116 (e.g., a secondary ankle cable guide 56).

Generally, each cable guide 56 can include an aperture 118 through which the tension cable 54 is routed, the aperture 118 being sized to permit free movement of the tension cable 54 therethrough. In some embodiments, a cable guide 56, such as the rear cable guide 56, can include multiple apertures 118 in order to route the tension cable 54 therethrough multiple times. More specifically, as shown in FIGS. 1, 3, and 4, the rear cable guide 56 includes two apertures 118 in order to route the tension cable 54 through the rear cable guide 56 twice. However, in some embodiments, two separate cable guides 56 may replace a dual-aperture rear cable guide 56. Further, in some embodiments, one or more cable guides 56 may include apertures 118 sized to accommodate multiple passes of the tension cable 54 such that the tension cable 54 is routed through the same aperture 118 of a cable guide 56 more than once.

One or more of the cable guides 56 can be coupled to an exterior surface 108 of the upper 42, as shown in FIGS. 1-4 or, alternatively, one or more of the cable guides 56 can be embedded or interwoven with a material of the upper 42 such that the tension cable 54 is routed through the upper 42. Generally, the cable guides 56 can comprise a material configured to hold the tension cable 54 adjacent the article of footwear 40 while still permitting smooth movement of the tension cable 54 therethrough during tensioning or loosening. Furthermore, in some embodiments, each cable guide 56 may be identical in size, shape, and material composition while, in other embodiments, the cable guides 56 may vary in size, shape, and/or material composition. For example, in some embodiments, one or more cable guides 56 can comprise a plastic material. In another example, as shown in FIGS. 1-4, in some embodiments, the rear cable guide 56 can be an extension of the heel counter 50 and, thus, comprise the same material as the heel counter 50. In some embodiments, one or more cable guides 56 may comprise fabric material, such as yarn stitched or looped to create the aperture 118. In further embodiments, one or more cable guides 56 may be in the form of an aperture 118 created in the material of the upper 42, such that the tension cable 54 is interwoven through the upper 42. Additionally, in some embodiments, the disc 58 can replace one of the front, rear, ankle, or another cable guide 56. For example, as shown in FIG. 2, the disc 58 replaces the front cable guide 56 and, as shown in FIG. 4, the disc 58 replaces the ankle cable guide 56.

The tension cable 54 can be a single cable in a loop, having a length such that, when the tension cable 54 is routed through the cable guides 56, it is capable of being at least slightly in tension when the article of footwear 40 is in a neutral or unworn orientation. Furthermore, when the tension cable 54 is in this initial tension state, it can cause the midsole 46 to slightly curve upward in tension, thereby preloading the midsole 46. When a user's movements cause the midsole 46 to further curve upward (e.g., shortening a distance between the front cable guide 56 and the rear cable guide 56), the tension cable 54 may be in a neutral state (i.e., non-tensioned or minimally tensioned). On the other hand, when the user's movements force the midsole 46 to flatten (e.g., lengthening the distance between the front cable guide 56 and the rear cable guide 56), the tension cable 54 is in a further tensioned state, causing it to squeeze around the upper 42 at the ankle region 102.

In some embodiments, the tension cable 54 can comprise one or more materials of sufficient strength to maintain the tension cable 54 in tension states, as well as allow movement of the tension cable 54 through the cable guides 56 (e.g., during flexing or extending movements of the user, or during tightening or loosening via the disc 58). For example, in some embodiments, the tension cable 54 may comprise steel, Dyneema® fabrics, or other suitable material(s).

Referring to FIG. 3, in some embodiments, the tension cable 54 can be factory loaded, i.e., set at an initial tension without the ability to be adjusted. The configuration illustrated in FIG. 3, therefore, does not include a disc 58. In other embodiments, however, as shown in FIGS. 1, 2, and 4, the tension cable 54 can be selectively loosened or tightened via the disc 58. The disc 58, similar to closure discs of alternative closure systems in shoes, can include internal mechanisms (not shown) that pull the tension cable 54 into the disc 58 when rotated, shortening and, thus, tightening the tension cable 54. When rotated an opposite way (or a release mechanism is otherwise activated), the disc 58 releases and lengthens and, thus, loosens the tension cable 54. As a result, the amount of initial tension provided by the tension cable 54 can be adjusted by a user by manipulating the disc 58.

Accordingly, referring to FIG. 1, the tension cable 54 is routed from the front cable guide 56 adjacent the front end 80, around the lateral side 92 through the lateral side cable guide 56, through the rear cable guide 56 at the rear end 82, around the medial side 94 and then through the ankle cable guide 56 at the ankle front 116, back around the lateral side 92 through a lateral heel cable guide 56, through the disc 58, around the medial side 94 through a medial heel cable guide (not shown) and then through the secondary ankle cable guide 56, back around the lateral side 92 again through the rear cable guide 56, then around the medial side 94 through a medial side cable guide (not shown) and back to the front cable guide 56. The disc 58, positioned on the heel counter 50 at the heel region 66, can tighten or loosen the tension cable 54 by a user manipulating the disc 58.

Referring to FIG. 2, the tension cable 54 is routed from the disc 58 adjacent the front end 80, around the lateral side 92 through the rear cable guide 56 at the rear end 82, around the medial side 94 through the ankle cable guide 56 at the ankle front 116, back around the lateral side 92 again through the rear cable guide 56, and back around the medial side 94 to the disc 58 adjacent the front end 80. The disc 58, positioned on the upper 42 in the forefoot region 62, can tighten or loosen the tension cable 54 by a user manipulating the disc 58. While FIG. 2 is illustrated without lateral or medial side cable guides, in some embodiments, the configuration of FIG. 2 can further include such lateral and/or medial side cable guides.

Referring to FIG. 3, the tension cable 54 is routed from the front cable guide 56 adjacent the front end 80, around the lateral side 92 through the rear cable guide 56 at the rear end 82, around the medial side 94 through the ankle cable guide 56 at the ankle front 116, back around the lateral side 92 through the rear cable guide 56, and back around the medial side 94 to the front cable guide 56. As noted above, in the configuration shown in FIG. 3, the tension cable 54 is "factory set" at an initial tension that generally cannot be adjusted by the user. Furthermore, while FIG. 3 is illustrated without lateral or medial side cable guides, in some embodiments, the configuration of FIG. 3 can further include such lateral and/or medial side cable guides.

Referring to FIG. 4, the tension cable 54 is routed from the front cable guide 56 adjacent the front end 80, around the lateral side 92 through a lateral side cable guide 56, through the rear cable guide 56 at the rear end 82, around the medial side 94 through the disc 58 at the ankle front 116, back around the lateral side 92 again through the rear cable guide 56, and back around the medial side through a medial side cable guide (not shown) to the front cable guide 56. The disc 58, positioned on the upper 42 at the ankle front 116, can tighten or loosen the tension cable 54 by a user manipulating the disc 58.

Referring to FIGS. 1-4, while four respective tension cable routing arrangements are shown and described herein, other routing arrangements and cable guide placements may be utilized in certain configurations. For example, in some embodiments, one or more medial side cable guides 56 and lateral side cable guides 56 can be positioned at the heel counter 50 at the medial side and the lateral side thereof, respectively. In other words, one or more side cable guides 56 may be positioned at the forefoot region 62, the midfoot region 64, and/or the heel region 66. Furthermore, some embodiments may include more or fewer cable guides 56 than what is shown and described herein. Additionally, while the tension cable 54 is shown and described herein as being a single cable, in some embodiments, multiple cables can be used in place of the single cable.

Figure 6:
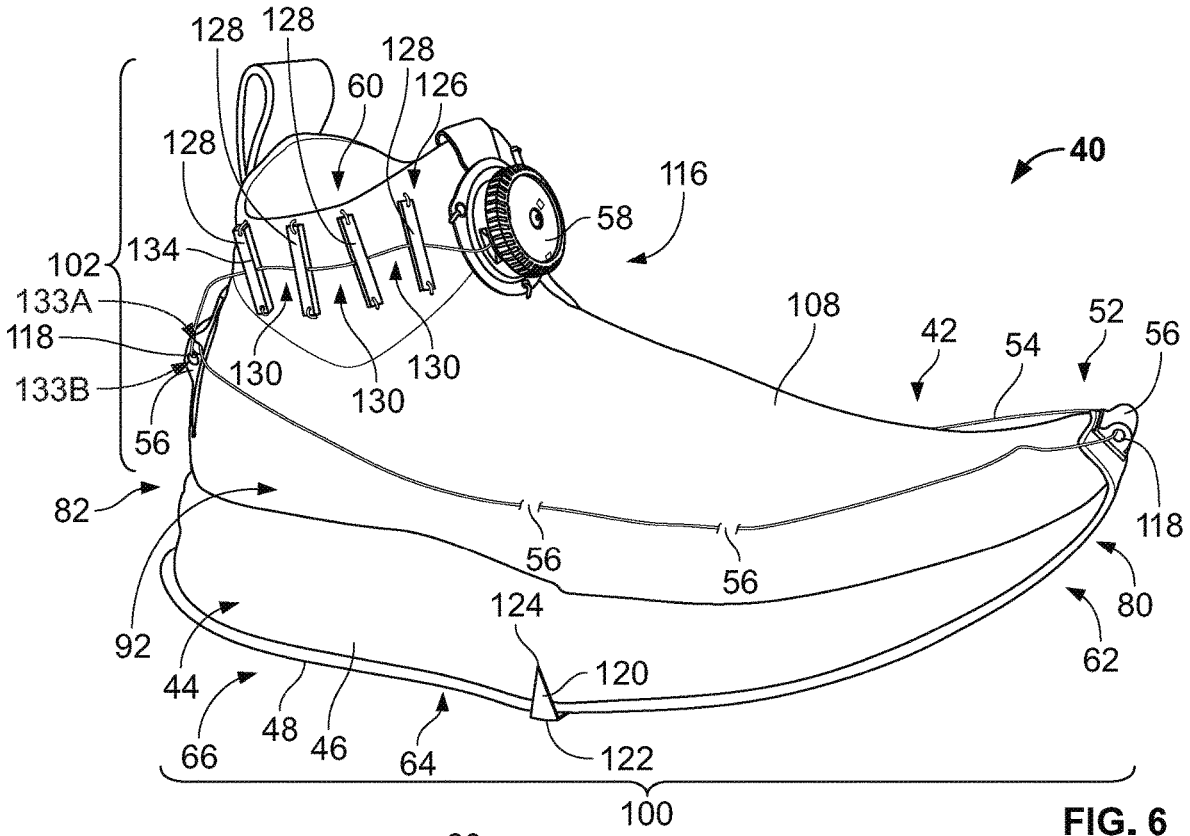
FIG. 6 is a lateral view of a right shoe comprising a preload system with a links system.
Figure 7:
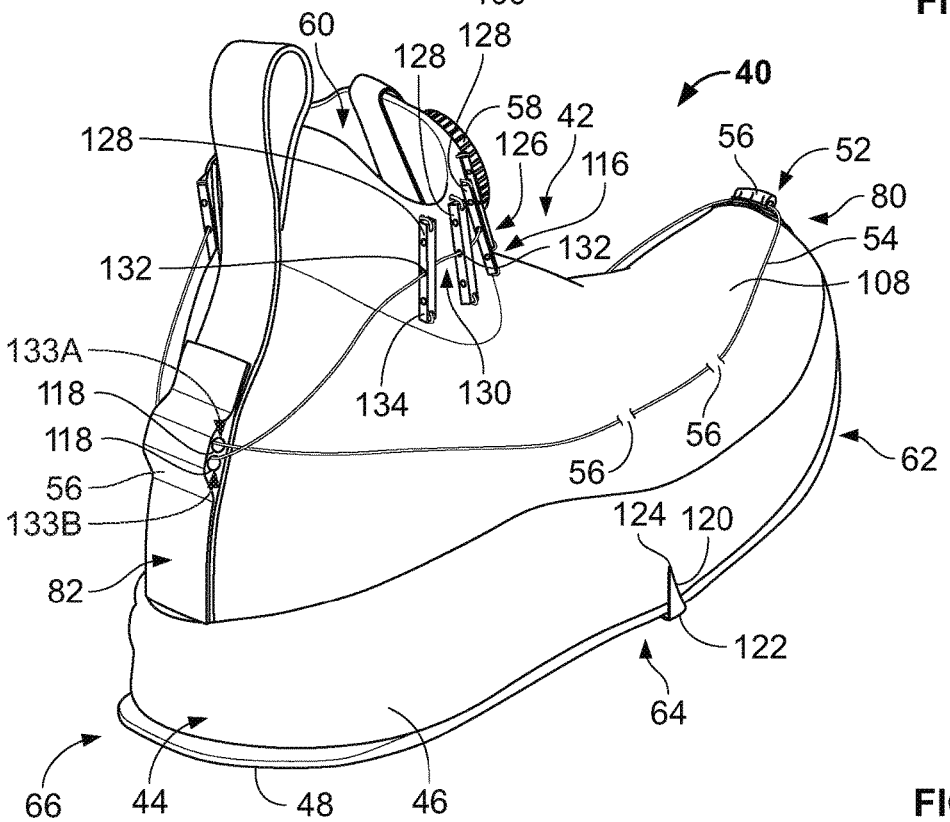
FIG. 7 is another lateral view of the right shoe of FIG. 6, having the preload system with the links system.

Referring now to FIGS. 6 and 7, in some embodiments, the preload system 52 may further comprise a wedge 120 integrated into the sole structure 44. In some embodiments, the wedge 120, based on its shape, position, and/or material composition, can facilitate more reliable and more robust curving (or preloading) of the midsole 46. For example, the wedge 120 can be provided to help direct movement of the midsole 46 during preloading. In some embodiments, the wedge 120 can extend from the midsole 46 through the outsole 48 and can extend across an entire width of the article of footwear 40 (i.e., from the lateral side 92 to the medial side 94). In some embodiments, however, the wedge 120 may extend across a portion of the entire width of the article of footwear 40. By extending across a width of the article of footwear 40 (i.e., an entire width or a portion thereof), the wedge 120 can generally extend perpendicular to the longitudinal, central axis 96.

Still referring to FIGS. 6 and 7, the wedge 120 can generally comprise a triangular cross-sectional shape, for example, having a base 122 and an opposite apex 124. The base 122 can be adjacent to the outsole 48 and at least partially contacts an exterior surface, e.g., the ground, when the article of footwear 40 is worn. The apex 124 can extend a set height into the midsole 46. Furthermore, the wedge 120 may be located at a position along the sole structure 44 in the midfoot region 64 or the forefoot region 62, such as adjacent the first line 86. For example, in some embodiments, the wedge 120 may be located at a position along the sole structure 44 adjacent to where the forefoot upward curve begins.

Furthermore, in some embodiments, the wedge 120 can comprise material similar to the material of the midsole 46 or the outsole 48. In other embodiments, the wedge 120 can have a different material composition than the midsole 46 and the outsole 48. For example, in some embodiments, the wedge 120 can comprise substantially flexible material. However, in other embodiments, the wedge 120 can comprise material that is more rigid than the material(s) of the midsole 46 and/or the outsole 48.

Figure 8:
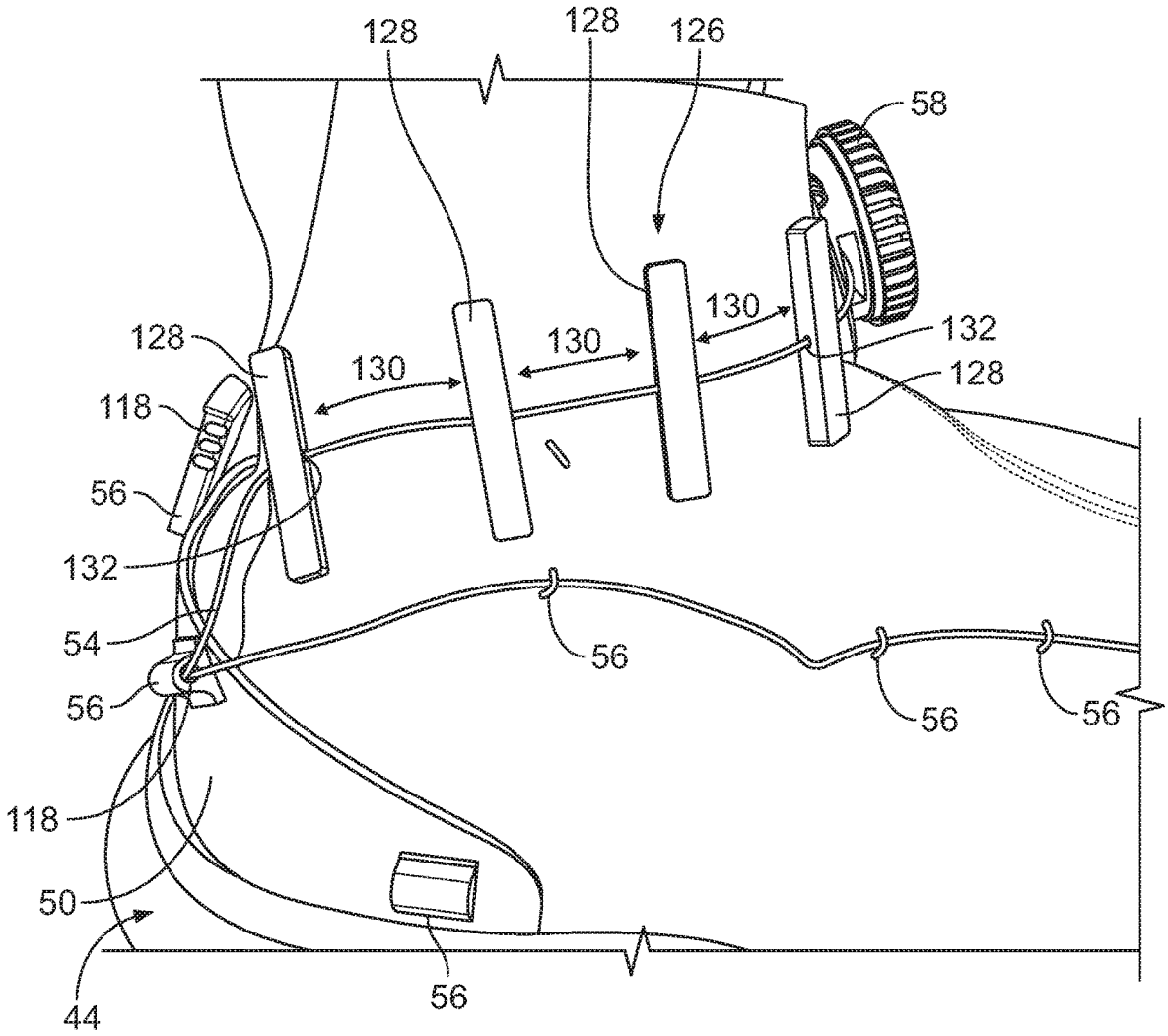
FIG. 8 is a partial detail view of a lateral view of a right shoe having a preload system with a links system.

Referring now to FIGS. 6-8, in some embodiments, the preload system 52 may further comprise a links system 126 configured to distribute compressive forces around the ankle region 102 in response to the tension cable 54 tightening around the ankle region 102. As such, the links system 126 can facilitate tightness and support around the user's ankle during midsole actuation, as further described below. Generally, the links system 126 comprises a plurality of links 128 coupled to the upper 42, acting as interface modules that can control movement and tightness of, as well as guide, the tension cable 54 along the material of the upper 42. As such, the links system 126 can provide a high level of control on the behavior of the upper 42 based on, for example, the composition and positioning of the individual links 128.

Still referring to FIGS. 6-8, each link 128 can be coupled to the upper 42 and the plurality of links 128 may be distributed around the ankle region 102, defining spaces 130 between each link 128. For example, in the embodiment of FIGS. 6-8, four links 128 can be distributed around the ankle region 102 on the lateral side 92 between the disc 58 and the rear cable guide 56, and four links 128 can be distributed around the ankle region 102 on the medial side 94 between the disc 58 and the rear cable guide 56, totaling eight links 128. However, other embodiments may include more or fewer links 128 distributed around the ankle region 102 (as shown in FIGS. 17-18 and 26-30). Furthermore, the links 128 are illustrated in FIGS. 6-8 as being distributed around the ankle region 102 with equal distancing therebetween when the upper 42 is in its neutral (i.e., initial tension) state. In other words, in the configuration of FIGS. 6-8, each space 130 is equal in length. However, some embodiments may include links 128 distributed at varying distances therebetween, such that the length of each space 130 varies. For example, the length of the spaces 130 between links 128 can be determined based on a desired upper material compression, and the overall distribution of the links 128 can be determined based on a desired distribution of upper material compression around the ankle region 102.

Referring in particular to FIG. 8, in some embodiments, the links 128 can be generally rectangular in shape, e.g., having long edges and short edges, and coupled to the upper 42 so that the long edges are substantially vertical. Furthermore, in some embodiments, the links 128 may be coupled to the upper 42 so that the long edges can generally align with a weave direction of the material of the upper 42. The links 128 can also be coupled to the upper 42 so that the links 128 on each of the lateral side 92 and the medial side 94 are arranged substantially parallel to one another.

Referring again FIGS. 6-8, the tension cable 54 can be routed through an aperture 132 of each link 128. As a result, when the tension cable 54 is pulled in tension (e.g., caused by actuation of the midsole 46 or manipulating the disc 58), the tension cable 54 pulls one or more links 128 and, thus, the material of the upper 42 where the respective link 128 is coupled, toward the next link 128 in the direction of the pull. For example, in some embodiments, tensioning the tension cable 54 pulls the links 128 and, thus, material of the upper 42, toward the rear end 82, therefore compressing the upper 42 around the user's ankle. Also, as shown in FIG. 7, the rear end 82 may comprise an embedded heel counter (not shown) and, thus, a rear cable guide 56 may be provided in the form of a cable-directing spine. As further illustrated in FIGS. 6 and 7, the rear cable guide 56 includes an upper channel 133A and a lower channel 133B, each configured to receive and route the tension cable 54 therethrough.

Additionally, the particular pull direction and compression region can be selected by incorporating one of the links 128 on each of the lateral side 92 and the medial side 94 as an anchor link 134, toward which all other links 128 move. For example, in the links system 126 of FIGS. 6-8, the anchor links 134 may be those positioned on the medial side 94 and the lateral side 92 closest to the rear end 82. As such, tensioning the tension cable 54 pulls the remaining links 128 and, thus, the upper material, toward the respective anchor links 134, therefore compressing the upper 42 around the user's ankle. It should be noted that, in some embodiments, an anchor link 134 may be a link further distal from the rear end 82 (i.e., not the most proximal link 128 to the rear end 82) in order to adjust a distribution of the compression around the ankle.

In some embodiments, an anchor link 134 can be defined by sizing the aperture 132 relative to the tension cable 54 to create minimal friction. In other words, the tension cable 54 may easily slide through the aperture 132 of the anchor link 134, causing the anchor link 134 to be anchored in place on the upper 42 regardless of tension cable 54 movement. Accordingly, in some embodiments, the anchor link 134 can include an aperture 132 having a first diameter, creating a first friction between an inner surface of the aperture 132 and the tension cable 54. The other links 128 can include apertures 132 each having a second diameter, smaller than the first diameter, creating a second friction between an inner surface of the apertures 132 and the tension cable 54, greater than the first friction. Additionally, in some embodiments, each of the lateral side 92 and the medial side 94 can include more than one anchor link 134.

In some embodiments, the tension cable 54 may be routed through the links 128 in a series manner, such that a first, most distal link 128 to the anchor link 134 moves first toward a second, adjacent link 128, then the second link 128 moves toward a third link 128, and so on until the last, most proximal link 128 to the anchor link 134 moves toward the anchor link 134. In other embodiments, the tension cable 54 may be routed through the links 128 in a parallel manner, such that all links 128 move toward the anchor link 134 simultaneously.

Furthermore, varying the sizing of the apertures 132 in the other links 128 (i.e., other than the anchor links 134), thereby adjusting the friction between the tension cable 54 and inner surfaces of the apertures 132, can affect an order in which the links 128 move toward the anchor link 134. For example, in some embodiments, as noted above, the anchor link 134 can include an aperture 132 having a first diameter creating a first friction with the tension cable 54, and one or more other links 128 can each include an aperture 132 having a second diameter, smaller than the first diameter, creating a second friction with the tension cable 54 greater than the first friction. Furthermore, yet one or more other links 128 can each include an aperture 132 having a third diameter, smaller than the second diameter, creating a third friction with the tension cable 54 greater than the second friction. In such embodiments, the links 128 with the greatest friction between the tension cable 54 and the aperture 132 (e.g., the third friction in this example) will move first when the tension cable 54 is pulled.

Additionally, in some embodiments, the tension cable 54 can further be woven through the upper 42 in the spaces 130 between respective links 128. In further embodiments, the links system 126 can include links 128 positioned along on an exterior surface 108 of the upper 42, as shown in FIGS. 6-8, as well as inverted links 128 positioned along an interior surface (not shown) of the upper 42, such that the tension cable 54 is woven through the upper 42 in order to be routed through the apertures 132 of the exterior and interior links 128. Weaving the tension cable 54 into the upper 42 within the spaces 130 and, moreover, incorporating inverted links 128, can increase movement of the upper 42 in the "Z-direction" when the tension cable 54 is tightened. The Z-direction may generally be defined by an axis perpendicular to the exterior surface 108 of the upper 42. In some embodiments, the increased Z depth of the upper 42 caused by the arrangement of the links 128 can provide added cushioning around the ankle of a user when the upper 42 is tightened around the ankle. Furthermore, the increased Z depth of the upper 42 can create supported depressions in the material of the upper 42 felt by the user as more focused points of compression.

In some embodiments, the links 128 may be substantially rigid and inflexible due to their material composition and/or cross-sectional shape. In other embodiments, the links 128 can be substantially flexible, capable of bending in one or more directions, due to their material composition and/or cross-sectional shape. As a result, the flexible links 128 have the ability to bend, for example, to contour to a user's ankle when coupled to the upper 42.

In light of the above, many characteristics (e.g., link distribution, link spacing, number of links, positioning of anchor links, friction levels, weaving, and/or inverting links, among other characteristics) can contribute to a selective compression of the upper 42 at the ankle region 102. Such characteristics can also vary across different areas of the ankle region 102 to provide targeted regions of specific compression. For example, in some embodiments, the links system 126 can be configured to provide more compression on the lateral side 92 than the medial side 94, or vice versa.

In light of the above, the preload system 52 selectively compresses or loosens the upper 42 around a user's ankle based on actuation of the midsole 46, wherein actuation of the midsole 46 can be caused by the user's foot and/or ankle movement. For example, referring now to FIGS. 9A-9C, the preload system 52 of some embodiments may provide three stages of preloading, based on the user's foot and ankle movement. For example, FIGS. 9A and 9C may be considered active stages, while FIG. 9B may be considered a neutral stage.

Figure 9A:
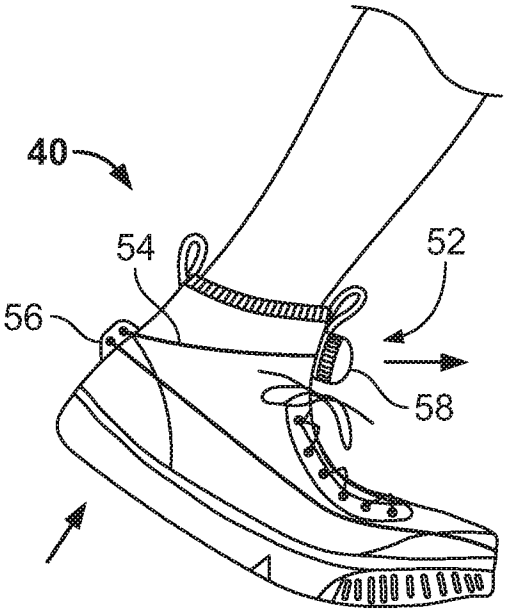
Figure 9B:
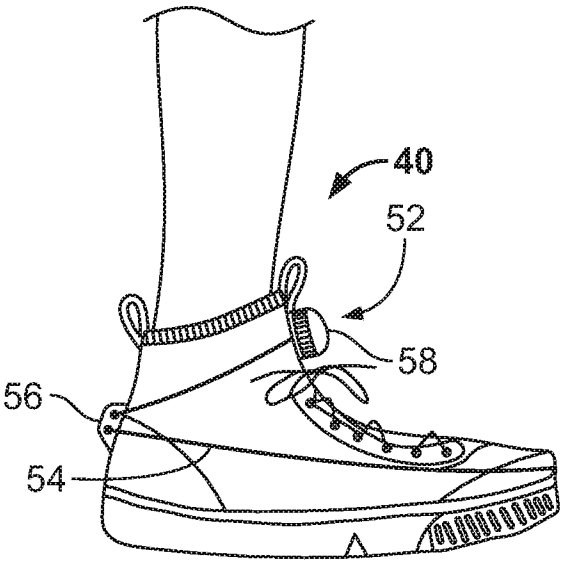
Figure 9C:
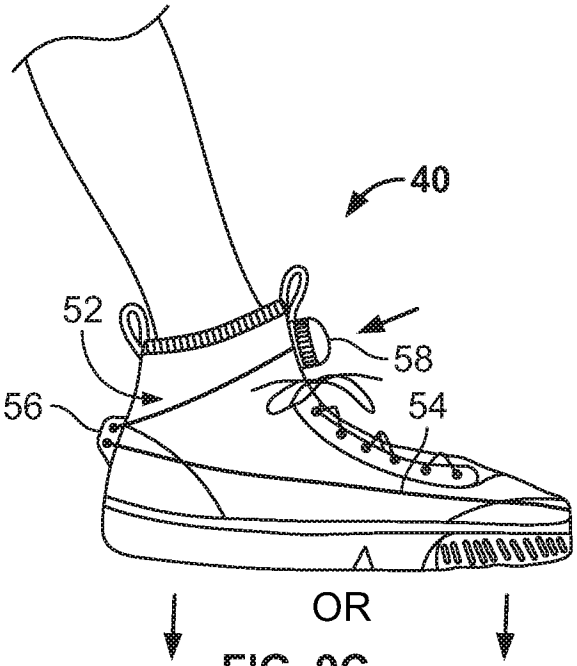

In particular, FIG. 9A illustrates a first stage where a user is bending their foot (i.e., bending the midsole 46) so that the heel is off the ground as well as the ankle is being pressed forward, causing the disc 58 to be pushed outward (such as when a user is pushing off to run or jump). In this first stage, the tension cable 54 is in a first, most relaxed, state. FIG. 9B illustrates a second, or neutral, stage where the user is standing. In this second stage, the tension cable 54 is in its initial tension state, less relaxed than in the first stage. FIG. 9C illustrates a third stage where the user is flattening their foot (i.e., flatting and actuating the midsole 46) either at the forefoot region 62 or the heel region 66, and the ankle is pressing backward, causing the disc 58 to be pressed rearward. In this third stage, the tension cable 54 is in a third, most tensioned, state, less relaxed than in the second stage and the first stage. As discussed above, compression of the upper 42 may be directly correlated to the amount of tension in the tension cable 54. Thus, the preload system 52 may provide the least compression of the upper 42 around the ankle of a user when in the first stage, and the most compression of the upper 42 around the user's ankle when in the third stage.

Figures 10A, 10B, 10C, 10D, 10E, 10F:
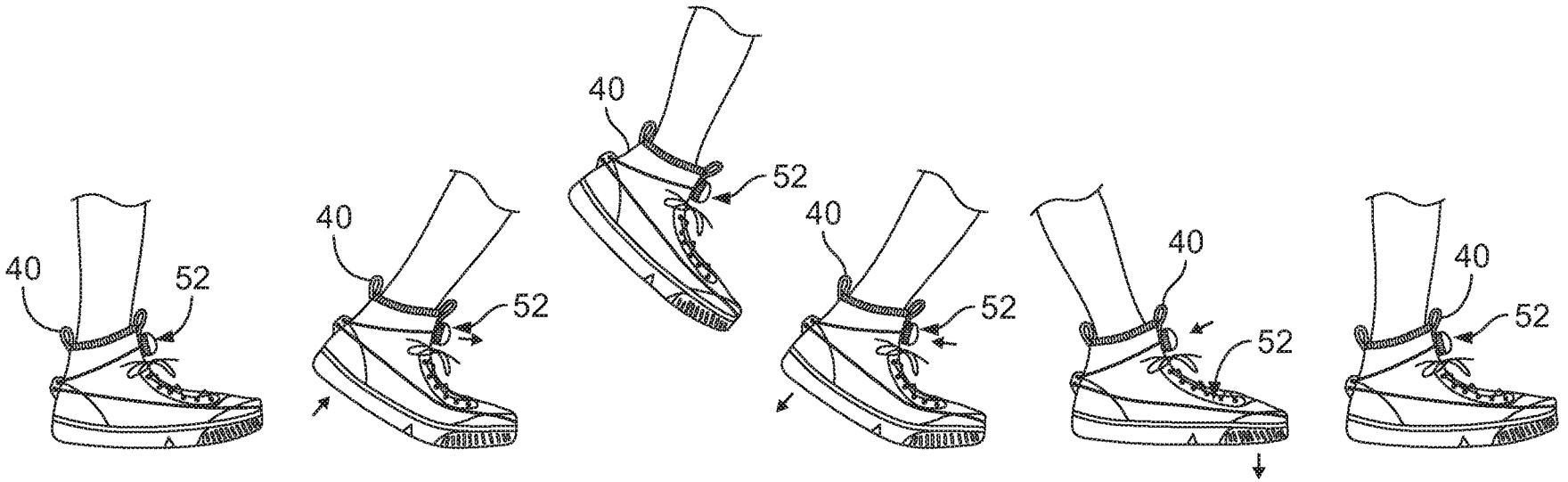
FIGS. 10A-10F are side views of user movements in a shoe comprising a preload system during an action sequence, where

The stages of preloading and their corresponding effects on the upper 42 can be designed in order to provide adaptive support to the user based on the user's movements during the particular stage. By way of example, FIGS. 10A-10F illustrate an action sequence, in particular, a jumping sequence, of a user wearing an article of footwear 40 with a preload system 52, and stages of the preload system 52 during the action sequence. FIG. 10A illustrates the user at rest, with the preload system 52 in the neutral stage. FIG. 10B illustrates the user taking off, where the heel is being pulled upward to bend or curve the midsole 46 and the ankle is moving forward (e.g., toward the toes). This causes the preload system 52 to enter an active stage and, in particular, the first stage providing the least ankle compression. FIG. 10C illustrates the user in the air, with the preload system 52 again in the neutral stage. FIG. 10D illustrates the user in an initial landing, where the heel is pressing toward the ground to flatten the midsole 46 and the ankle is pressing back (e.g., away from the toes). This causes the preload system 52 to enter an active stage and, in particular, the third stage providing the most ankle compression. Furthermore, FIG. 10E illustrates the user completing the landing, where the toe is pressing down toward the ground to flatten the midsole 46 and the ankle is continuing to press back. Here, the preload system 52 remains in the third stage providing the most ankle compression. Finally, at FIG. 10F, the user is again at rest and the preload system 52 is again in the neutral stage.

With respect to the first stage (FIGS. 9A and 10B), the first stage provides the least amount of ankle compression and, thus, the least resistance to ankle movement, which can assist with a takeoff More specifically, in some instances, a stiff or compressed ankle region 102 in a shoe 40 generally limits ankle mobility and can, thus, potentially hinder take off by limiting a bend angle of the ankle. Thus, by providing minimal compression during a takeoff, the preload system 52 can provide sufficient ankle flexibility for maximum ankle movement. On the other hand, with respect to the third stage (FIGS. 9C, 10D, and 10E), the third stage provides the most ankle compression and, thus, the most resistant to ankle movement, which can support the ankle during landing. More specifically, a common ankle injury includes rolling the ankle when landing, especially when the user's muscles are fatigued. The preload system 52, by providing more ankle compression and, thus, more ankle support during movements like landing, can increase ankle stability and reduce rolling. Furthermore, with respect to the second stage (FIGS. 9B, 10A, 10C, and 10F), the second stage provides an initial amount of ankle compression, less than the third stage. By automatically changing from the third stage back to the second stage after landing (e.g., in the transition from FIG. 10E to 10F), the preload system 52 can release the ankle compression so that the user can, for example, feel more comfortable taking off running after landing (e.g., due to the additional ankle flexibility afforded by the second stage).

Accordingly, the preload system 52 described above with reference to FIGS. 1-10F is an adaptive actuation system in that it immediately responds to a user's movements, actuating the tension cable 54 to support the user as needed during the specific movements. The preload system 52 of FIGS. 1-10F is activated to achieve a tightening affect around the ankle of the user, for example, to assist during takeoff and landing with running and jumping. Furthermore, in some embodiments, referring to FIGS. 11-14, the adaptive actuation system may alternatively or additionally be activated to achieve a tightening affect across the forefoot region 62, for example, to assist during cutting and lateral movements.

Figure 11:
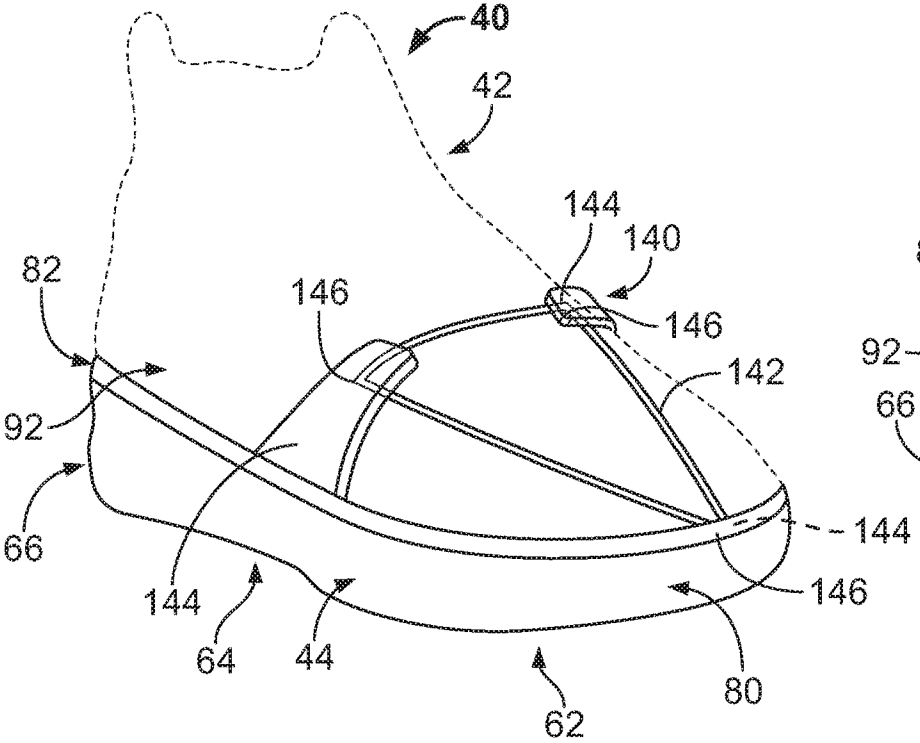
FIG. 11 is a lateral view of a right shoe comprising a lateral activation system.

In particular, FIG. 11 illustrates an article of footwear 40 with an adaptive actuation system in the form of a lateral activation system 140. The lateral activation system 140 includes a tension cable 142 and a plurality of cable guides 144. Generally, the lateral activation system 140 may be secondary to the closure system of the article of footwear 40 (such as a lacing system) in achieving a lateral tightening affect and lateral support for the upper 42, generally in the forefoot region 62. This additional tightening affect and lateral support, for example, can help prevent a foot of a user from laterally sliding along the insole 98 within the interior cavity 60 when the user is moving laterally.

Referring to FIG. 11, the tension cable 142 can be coupled to the upper 42 and/or the sole structure 44 at a plurality of anchor points 146, generally all in the forefoot region 62, though some anchor points may extend into the midfoot region 64 in some embodiments. As shown in FIG. 11, a first anchor point 146 may be located adjacent the front end 80, a second anchor point 146 may be located along the lateral side 92 adjacent the first line 86 (e.g., adjacent the widest portion 84 of the article of footwear 40), and a third anchor point 146 may be located along the medial side 94 adjacent the first line 86. While the second and third anchor points 146 are described as being adjacent the widest portion 84 of the article of footwear 40, in some embodiments, the anchor points 146 may be located at a point between the widest portion 84 and the thinnest portion 88.

Each anchor point 146 can include a corresponding cable guide 144. For example, though not shown in FIG. 11, the first anchor point 146 can include a front cable guide 144 similar to the front cable guide 56 illustrated and described above with reference to FIGS. 1-7. The second anchor point 146 can include a side cable guide 144 that extends from the sole structure 44 along the lateral side 92 and terminates before reaching the longitudinal central axis 96. The third anchor point 146 can include a side cable guide 144 that extends from the sole structure 44 along the medial side 94 and terminates before reaching the longitudinal central axis 96 (such as in a mirror image to the lateral side cable guide 144). In some embodiments, the side cable guides 144 can comprise a substantially flexible material that contours to the exterior surface 108 of the upper 42. Furthermore, each cable guide 144 can include an aperture (not shown) configured to receive the tension cable 142, similar to the apertures 118 of the cable guides 56 described above with respect to FIGS. 1-7.

Referring still to FIG. 11, the tension cable 142 may be routed through the cable guides 144 at the anchor points 146 and may be configured to be in tension to provide a tightening sensation in the forefoot region 62, e.g., at least by pulling the side cable guides 144 toward each other. For example, in some embodiments, the tension cable 142 may include similar characteristics and composition as the tension cable 54 described above with respect to FIGS. 1-7.

Figure 12:
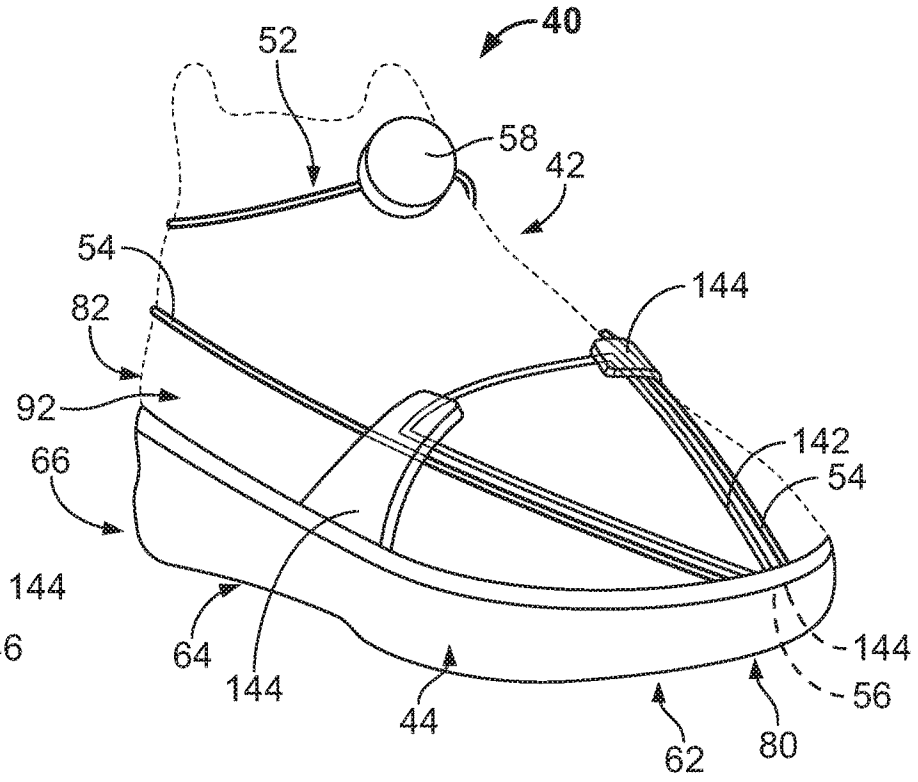
FIG. 12 a lateral view of a right shoe comprising a lateral activation system and a preload system.

Referring now to FIG. 12, in some embodiments, an article of footwear 40 can include both a preload system 52, as described above with respect to FIGS. 1-10F, and a lateral activation system 140, as described above with respect to FIG. 11.

Figure 13:
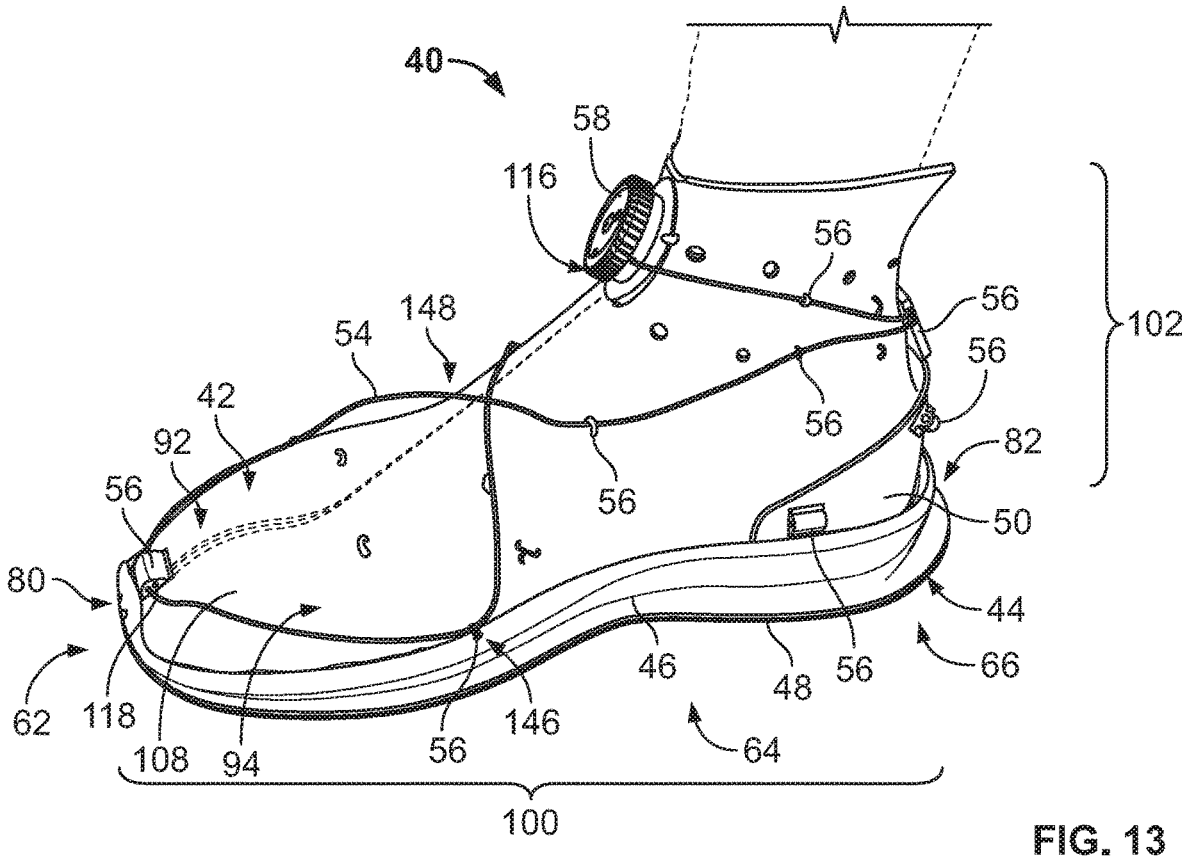
FIG. 13 is a medial view of a right shoe comprising a hybrid preload system and lateral activation system according to a first configuration.
Figure 14:
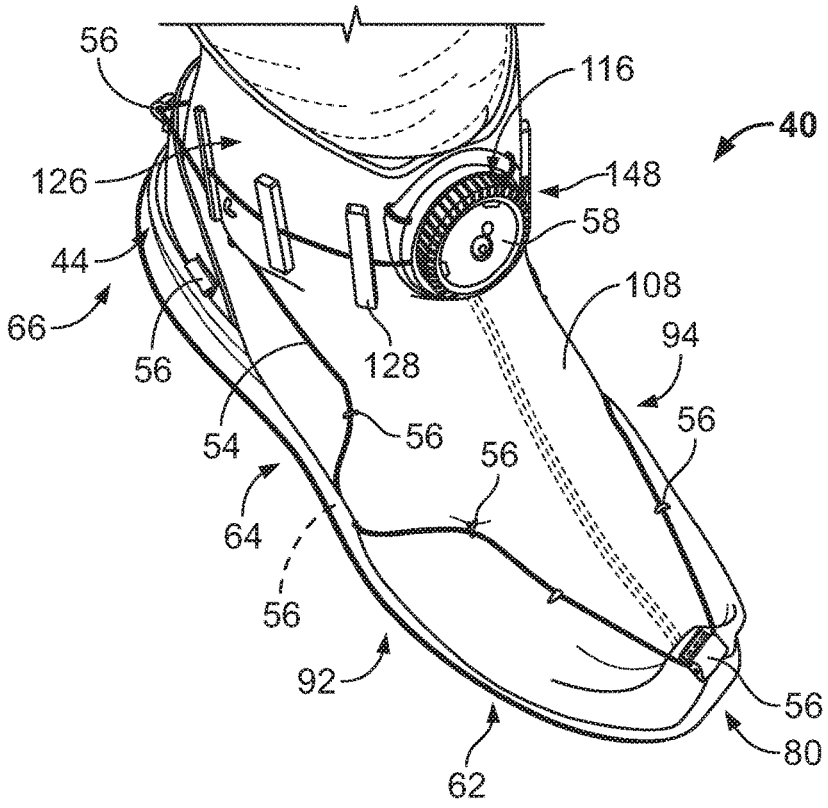
FIG. 14 is lateral view of a right shoe comprising a hybrid preload system and lateral activation system according to a second configuration.

Furthermore, with reference FIGS. 13 and 14, an article of footwear 40 can include a hybrid preload system 148, which includes characteristics of both the preload system 52 and the lateral activation system 140. In other words, the article of footwear 40 includes an adaptive actuation system in the form of a hybrid preload and lateral activation system 148. Generally, the hybrid preload system 148 can include the same components as the preload system 52 described above with respect to FIGS. 1-10F (i.e., a tension cable 54, a plurality of cable guides 56, and, optionally, a disc 58). However, the hybrid preload system 148 can include additional anchor points 146 adjacent the first line 86 along the lateral side 92 and the medial side 94, each at or extending from the sole structure 44 (e.g., acting in a similar manner as the side cable guides 144 of the lateral activation system 140 of FIGS. 11 and 12).

Accordingly, referring to FIG. 13, the tension cable 54 is routed from a front cable guide 56 adjacent the front end 80, around the medial side 94 through a medial side cable guide 56 adjacent the sole structure 44 at or adjacent the first line 86, across the longitudinal central axis 96 (e.g., over the bridge of a foot of a user) and around the lateral side 92 through a rear cable guide 56 at the rear end 82, around the medial side 94 and then through disc 58 at the ankle front 116, back around the lateral side 92 through the rear cable guide 56, then around the medial side 94 through a medial heel cable guide (not shown) and then through the secondary ankle cable guide 56, back around the lateral side 92 again through the rear cable guide 56, then around the medial side 94 and across the longitudinal central axis 96, crossing over itself, through a lateral side cable guide (not shown) adjacent the sole structure 44 at or adjacent the first line 86, and back to the front cable guide 56. The disc 58, positioned on the upper 42 at the ankle front 116, can tighten or loosen the tension cable 54 by a user manipulating the disc 58. Furthermore, in this arrangement, the medial and lateral anchor points provided at the sole structure 44, as well as the crisscrossing of the tension cable 54, can provide sufficient lateral activation or tightening adjacent the forefoot region 62 when the tension cable 54 is actuated.

Referring to FIG. 14, the tension cable 54 is routed from the front cable guide 56 adjacent the front end 80, around the lateral side 92 through a first lateral side cable guide 56 in the forefoot region 62 spaced away from the sole structure 44, through a second lateral side cable guide 56 adjacent the sole structure 44 at or adjacent the first line 86, through a third lateral side cable guide 56 in the midfoot region 64 spaced away from the sole structure 44, through the rear cable guide 56 at the rear end 82, around the medial side 94 through the disc 58 at the ankle front 116, back around the lateral side 92 through the rear cable guide 56, and back around the medial side through first, second, and third medial side cable guides (not shown) that are similar in positioning to the first, second, and third lateral side cable guides 56 described above, to the front cable guide 56. The disc 58, positioned on the upper 42 at the ankle front 116, can tighten or loosen the tension cable 54 by a user manipulating the disc 58. As shown in FIG. 14, the first, second, and third lateral side cable guides 56 (and the first, second, and third medial side cable guides), form a "V" configuration, anchored at the sole structure 44, which can provide sufficient lateral activation or tightening adjacent the forefoot region 62 when the tension cable 54 is actuated.

Referring to FIGS. 13 and 14, while two respective tension cable routing arrangements are shown and described herein, other routing arrangements and cable guide placements may be utilized in certain embodiments. Furthermore, some embodiments may include more or fewer cable guides 56 than what is shown and described herein. For example, as shown in FIG. 14, the hybrid preload system 148 can include additional cable guides 56 (e.g., in the form of fabric loops) through which the tension cable 54 is routed. Additionally, while the tension cable 54 is shown and described herein as being a single cable, in some embodiments, multiple cables can be used in place of the single cable.

The adaptive actuation systems described above with respect to FIGS. 1-14, that is, the preload system 52, the lateral activation system 140, and the hybrid preload system 148, may all be considered passive systems in that actuation is achieved passively, in response to a user's movements, through action of the tension cable 54, 142. Such actuations include compression of the upper 42 at the ankle region 102 and/or the forefoot region 62. However, other areas of compression may be contemplated in some embodiments using the principles for passive actuation systems described above.

Furthermore, referring now to FIGS. 15-32, in some embodiments, an article of footwear 40 can include adaptive actuation systems in the form of active systems, which actively respond to a user's movements to support specific areas of the user's foot. For example, such active systems can provide a real-time, custom fit that responds quickly to the user's movements. More specifically, in some embodiments, the active systems described here can generally incorporate one or more motors configured to maneuver (e.g., tighten or loosen) cables coupled to an upper 42 of an article of footwear 40 in order to compress specific regions of the upper 42. As such, these active systems generally provide for a motorized shoe 40 that adapts to a user's movements.

Figure 15:
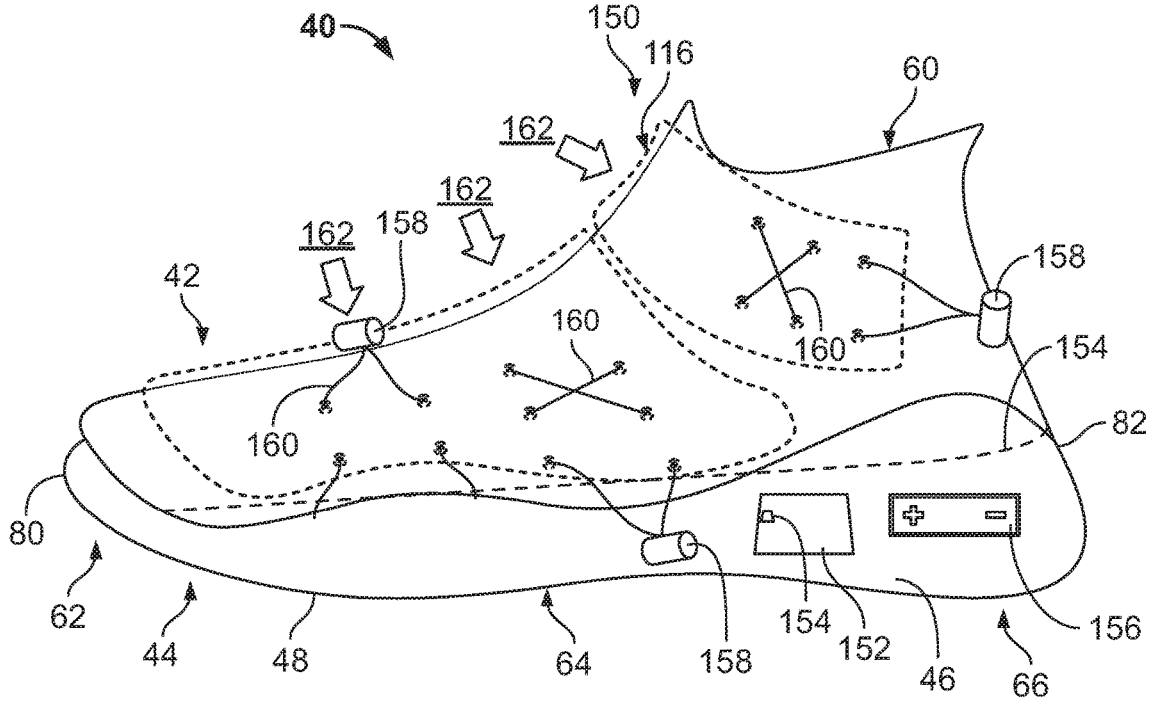
FIG. 15 is a lateral view of a left shoe comprising an active response system.

For example, FIG. 15 depicts an article of footwear 40, according to some embodiments, with an upper 42, a sole structure 44 having at least a midsole 46 and an outsole 48, and an adaptive actuation system in the form of an active response system 150. The active response system 150 includes a controller 152, one or more sensors 154, a power source 156, at least one motor 158, and at least one cable 160 coupled to the upper 42. The motor 158 is configured to selectively adjust tension in the cable 160, as controlled by the controller 152 based on input from the one or more sensors 154, in order to compress a region of the upper 42. The electronics of the active response system 150 (e.g., at least the controller 152, the power source 156, and/or one or more sensors 154) can be embedded within the midsole 46. The additional electronics, such as the motors 158, may be embedded within the midsole 46 and/or otherwise coupled to or embedded within the sole structure 44 and/or the upper 42. Furthermore, in some embodiments, as shown in FIG. 15, at least one sensor 154 (such as a pressure sensor) can be positioned adjacent or along the insole 98. The article of footwear 40 may also include additional components not specifically addressed herein.

Referring to FIG. 15, the article of footwear 40 can include one or more compression zones 162 (in this instance, three zones 162), each having a dedicated motor 158. Each compression zone 162 can be defined by a respective cable 160 that is coupled to the upper 42 and coupled to and maneuverable by the motor 158 in order to compress the upper 42 at the compression zone 162. As shown in FIG. 15, a first compression zone 162 may be located in the forefoot region 62 in order to compress the upper 42 at the forefoot region 62 (e.g., adjacent the widest portion 84 to provide adjustable lateral support to a user). A second compression zone 162 may be located in the midfoot region 64 in order to compress the upper 42 at the midfoot region 64 (e.g., adjacent the bridge or instep of a user's foot). A third compression zone 162 may be located in the heel region 66 in order to compress the upper 42 at the heel region 66 (e.g., at the ankle region 102).

As discussed above with respect to the adaptive actuation systems of FIGS. 1-14, fatigue can cause slight changes in a user's foot and ankle movements, delayed corrections to such changes, and/or delayed responses for actively engaging and supporting the foot and ankle during movement, which can lead to injury. In some embodiments, the active response system 150 can counteract the effects of fatigue and/or delay fatigue by actively responding to the user's movements and adapting to provide support where needed. For example, in some embodiments, the active response system 150 collects movement data from the user via the sensor(s) 154, analyzes the data, for example, to determine specific metrics and patterns related to the user's movements, and provides a dynamic fit of the article of footwear 40 to the user's foot through changes in tightness and/or physical shape, color, or other types of physical actuation of the article of footwear 40 based on the user's movements. In other words, the active response system 150 of some embodiments can perform real-time sensing of user movements, recognize or classify the user's activity based on the sensed movements, determine an optimal "fit state" of the article of footwear 40 to the user's foot, and actuate the motor(s) 158 to achieve the optimal fit state, as further described herein below.

Figure 16:
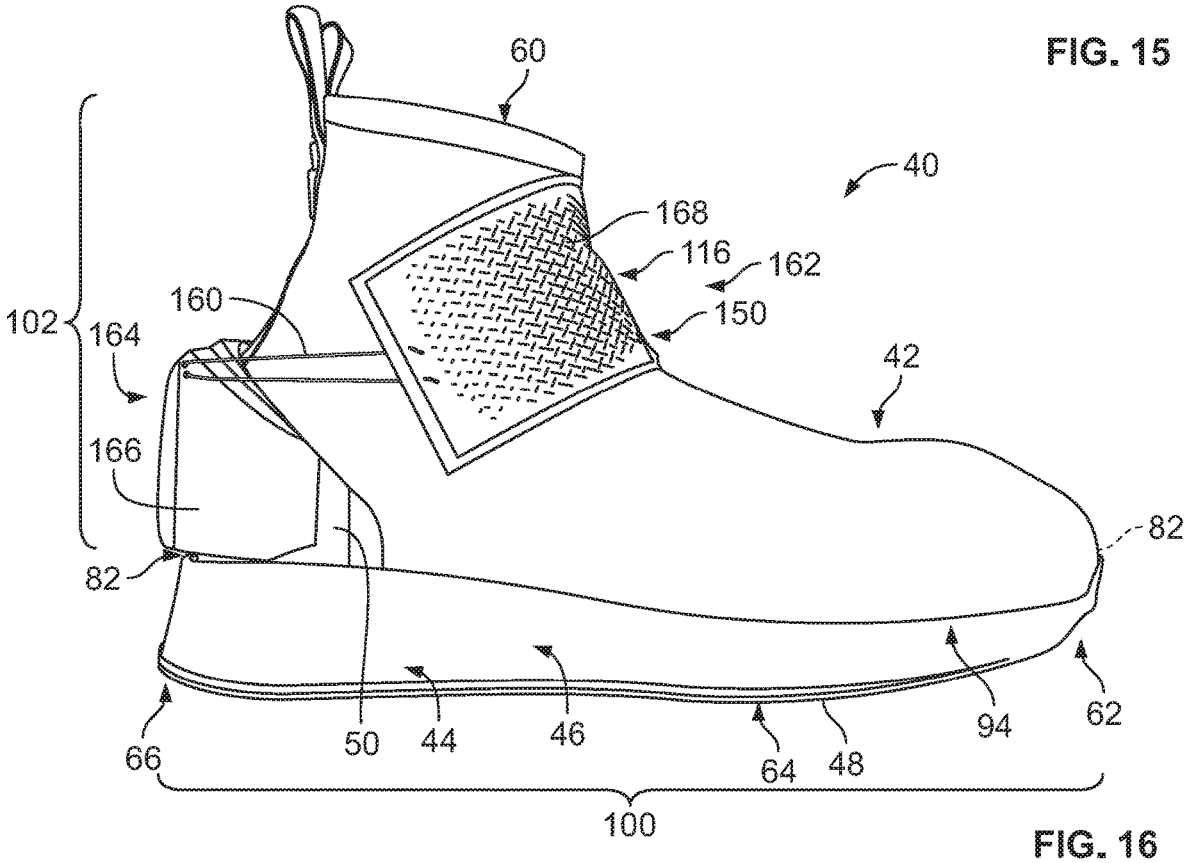
FIG. 16 is a lateral view of a right shoe comprising an active response system with an ankle cup and an ankle strap.
Figure 17:
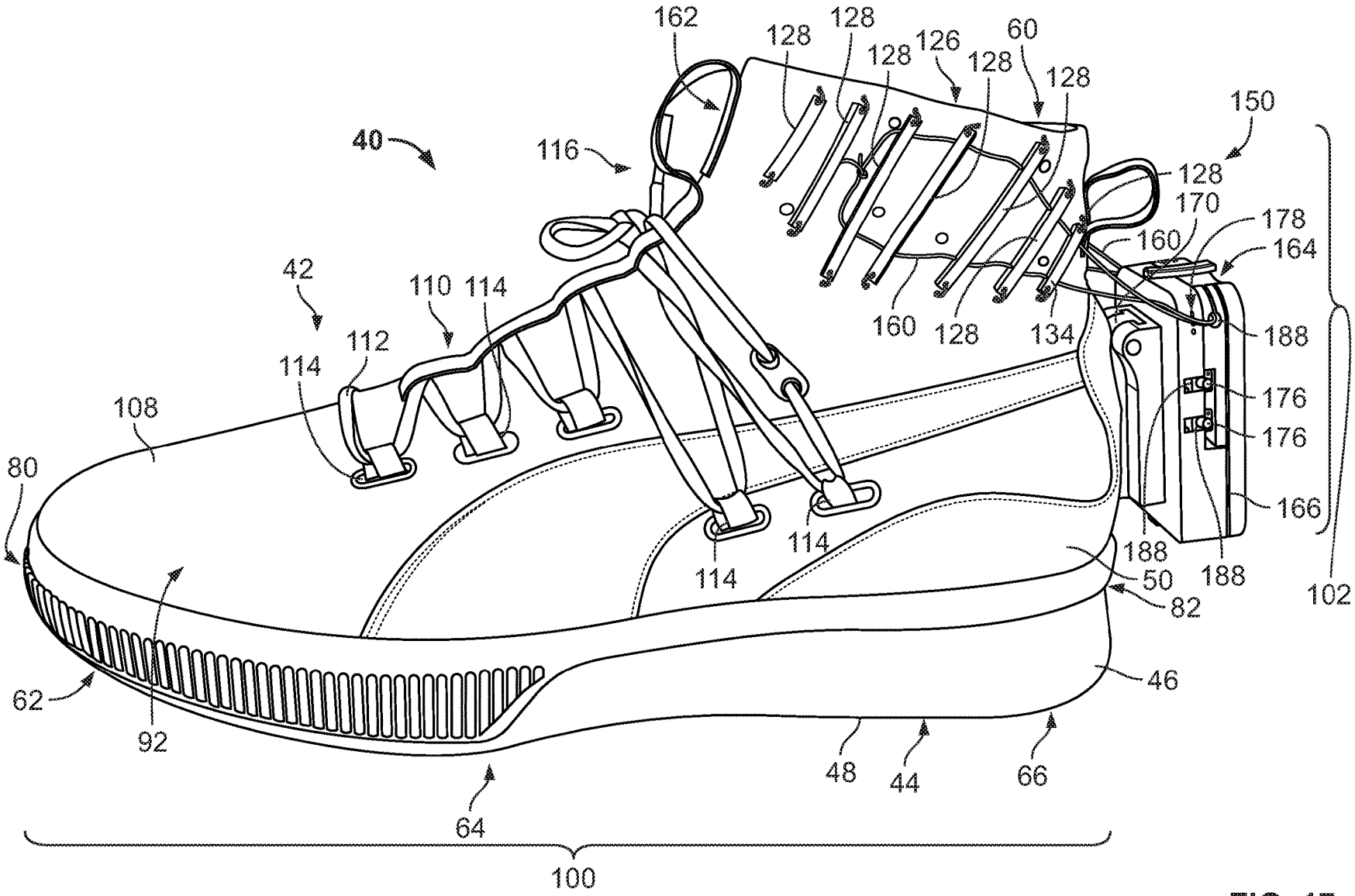
FIG. 17 is a lateral view of a left shoe comprising an active response system with a portable ankle cup.

FIG. 16 depicts an article of footwear 40, according to some embodiments, with an active response system 150 having an ankle cup 164 that houses electronics (e.g., at least a controller, one or more sensors, a power source, and a motor), rather than such electronics being stored in the midsole 46, as illustrated and described above with respect to FIG. 15. In some embodiments, the ankle cup 164 can include a housing 166 that holds the electronics. The housing 166 can be coupled to the upper 42 and, more specifically, coupled to the heel counter 50 (e.g., for added support, given the more rigid material of the heel counter 50 compared to the other, more flexible material of the upper 42).

As shown in FIG. 16, the article of footwear 40 can include a compression zone 162 in communication with the ankle cup 164. The compression zone 162 can be defined by an ankle strap 168 wrapped at least partially around the ankle region 102 of the upper 42 and coupled to at least one cable 160 that is connected to and maneuverable by the motor 158 in the housing 166 of the ankle cup 164. Thus, as shown in FIG. 16, the cable 160 can be coupled to the ankle strap 168 and extend into the housing 166 to be coupled to the motor 158. Furthermore, as shown in FIG. 16, a single cable 160 can be routed in a loop between the motor 158 and the ankle strap 168. While only one cable 160 is illustrated in FIG. 16, in particular, on the medial side 94 of the article of footwear 40, in some embodiments, an additional cable and motor combination can be located along the lateral side 92 of the article of footwear 40, such that the compression zone 162 includes two cables 160 and two individually controlled motors 158.

While only one compression zone 162 is illustrated in FIG. 16 (and discussed with respect to FIGS. 16-23 and 25-32), in some embodiments, additional compression zones 162 may be located on the upper 42 and in communication with the ankle cup 164. Furthermore, while FIG. 16 depicts all electronics stored in the ankle cup 164, in some embodiments, one or more of the electronics (such as one or more sensors or other electronics) may instead be stored or embedded within the sole structure 44 and/or the upper 42.

Figure 18:
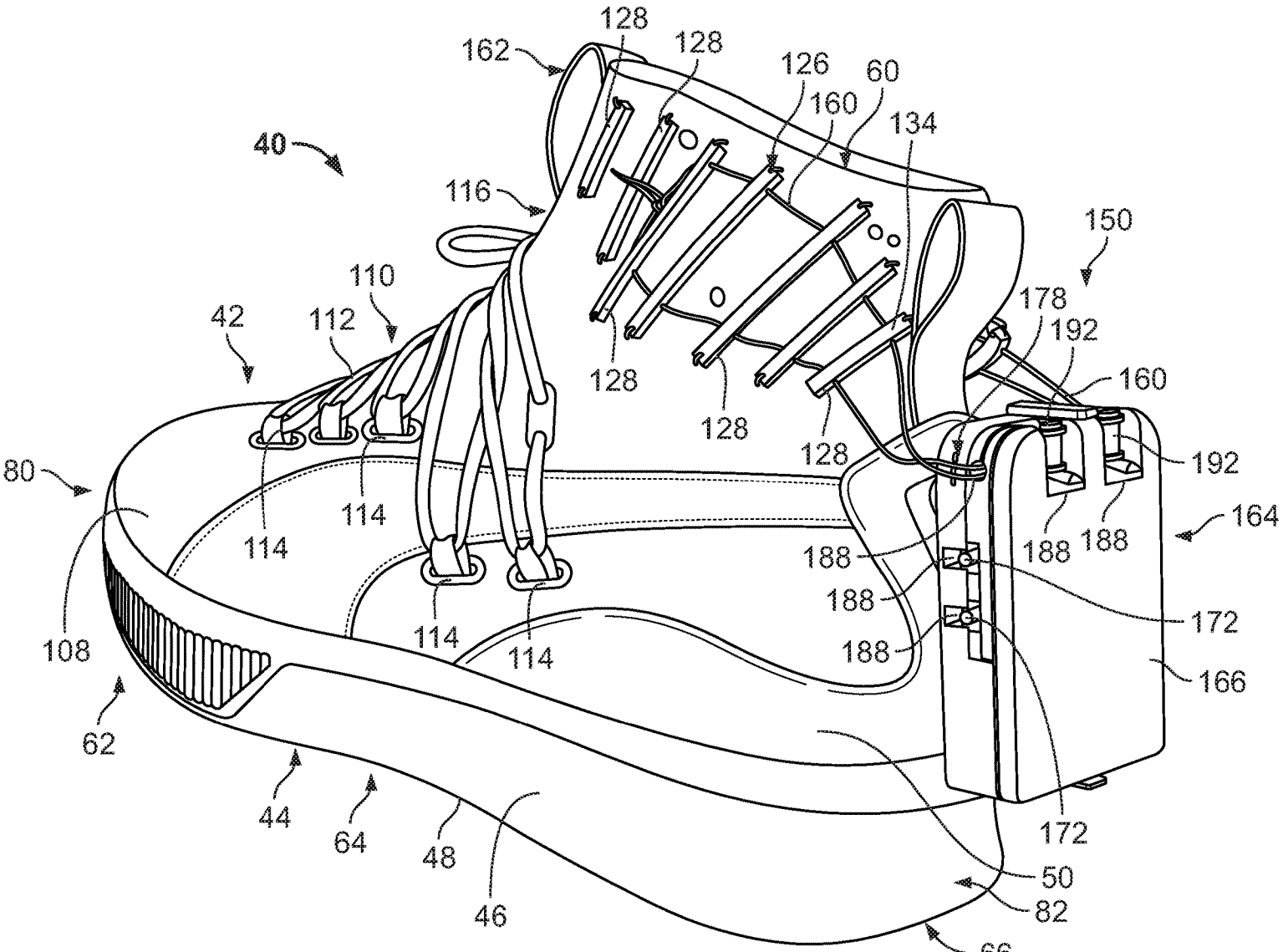
FIG. 18 is another lateral view of the left shoe of FIG. 17 comprising the active response system with the portable ankle cup.
Figure 19:
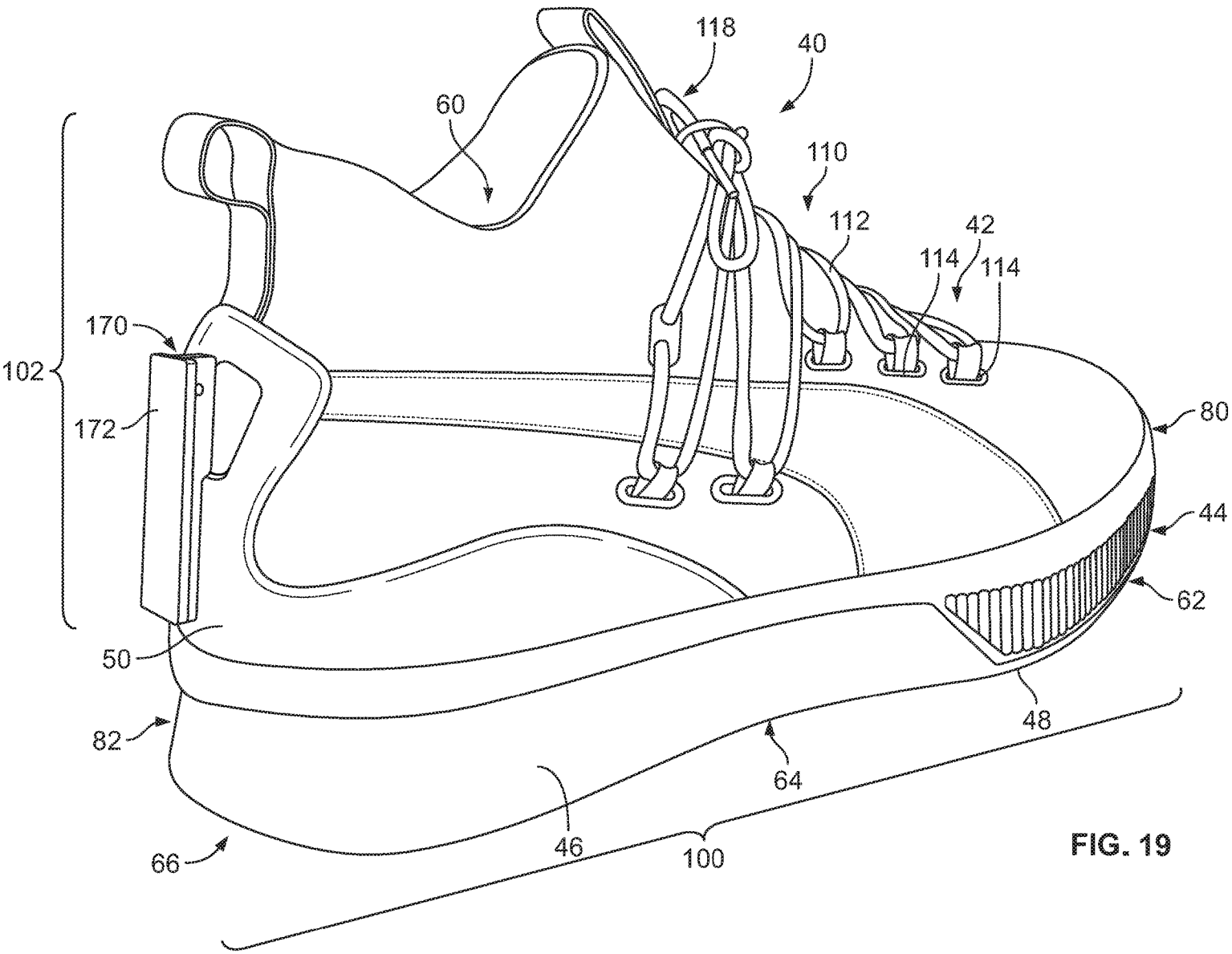
FIG. 19 is a lateral view of a right shoe comprising the active response system of FIG. 17 with a housing of the ankle cup detached.

Referring now to FIGS. 17-21, in some embodiments, an article of footwear 40 can include an active response system 150 with a portable ankle cup 164. That is, the ankle cup 164 can include a housing 166 (shown in FIGS. 17, 18, 20, and 21) that is removeably coupled to the article of footwear 40 via a guide 170 (shown in FIG. 19). For example, as shown in FIG. 19, the guide 170 may be coupled to or integral with the heel counter 50 and comprise a protrusion 172. The housing 166 can include, on a front side thereof, a track 174 configured to slide onto the protrusion 172 in order to couple the housing 166 to the guide 170. Additionally, in some embodiments, different coupling mechanisms may be incorporated into the guide 170 and/or the housing 166 to facilitate removably coupling the housing 166 to the guide 170.

Referring still to FIGS. 17-21, the active response system 150 can further include medial and lateral cables 160 coupled to the upper 42 adjacent the ankle region 102 along the medial side 94 and the lateral side 92, respectively. Furthermore, the cables 160 can be coupled to the upper 42 via a links system 126, similar to that described above with respect to FIGS. 6-8. The cables 160 can be coupled to respective motors 158 within the housing 166 and extend out of the housing 166 to be coupled to the upper 42, for example, by each being routed through respective links 128 and tied together to form a loop. Thus, when a user desires to remove the portable ankle cup 164 from the article of footwear 40, the user can untie each cable 160, pull them out from the links system 126 to uncouple the cables 160 from the upper 42, and pull the housing 166 off of the guide 170 (i.e., by sliding the track 174 from the protrusion 172).

Figure 21:
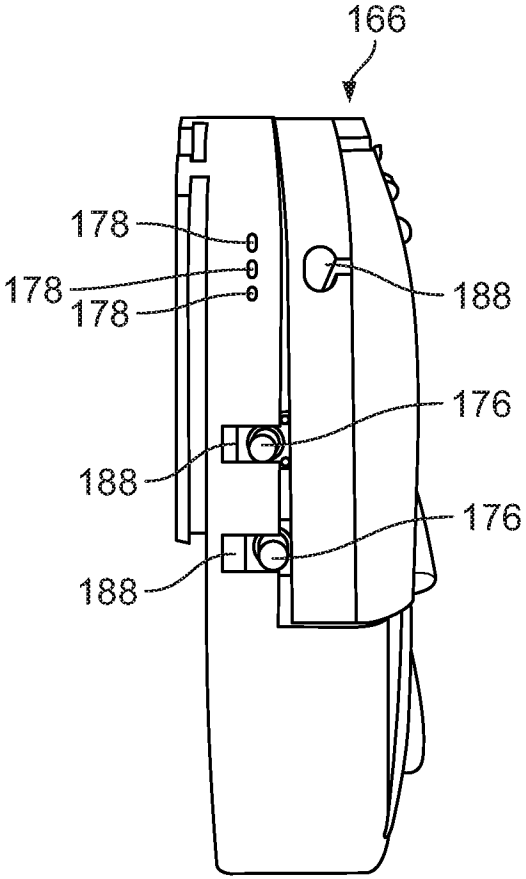
FIG. 21 is a side view of the housing of the portable ankle cup of FIG. 17.
Figure 20:
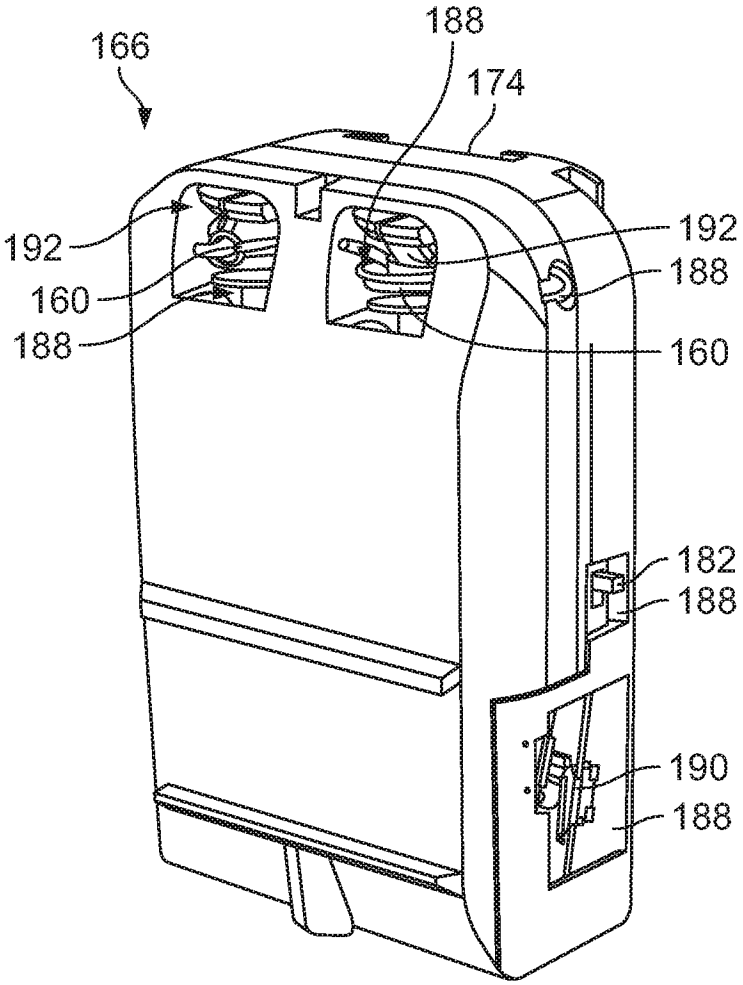
FIG. 20 is a perspective view of a housing of the portable ankle cup of FIG. 17.
Figure 22:
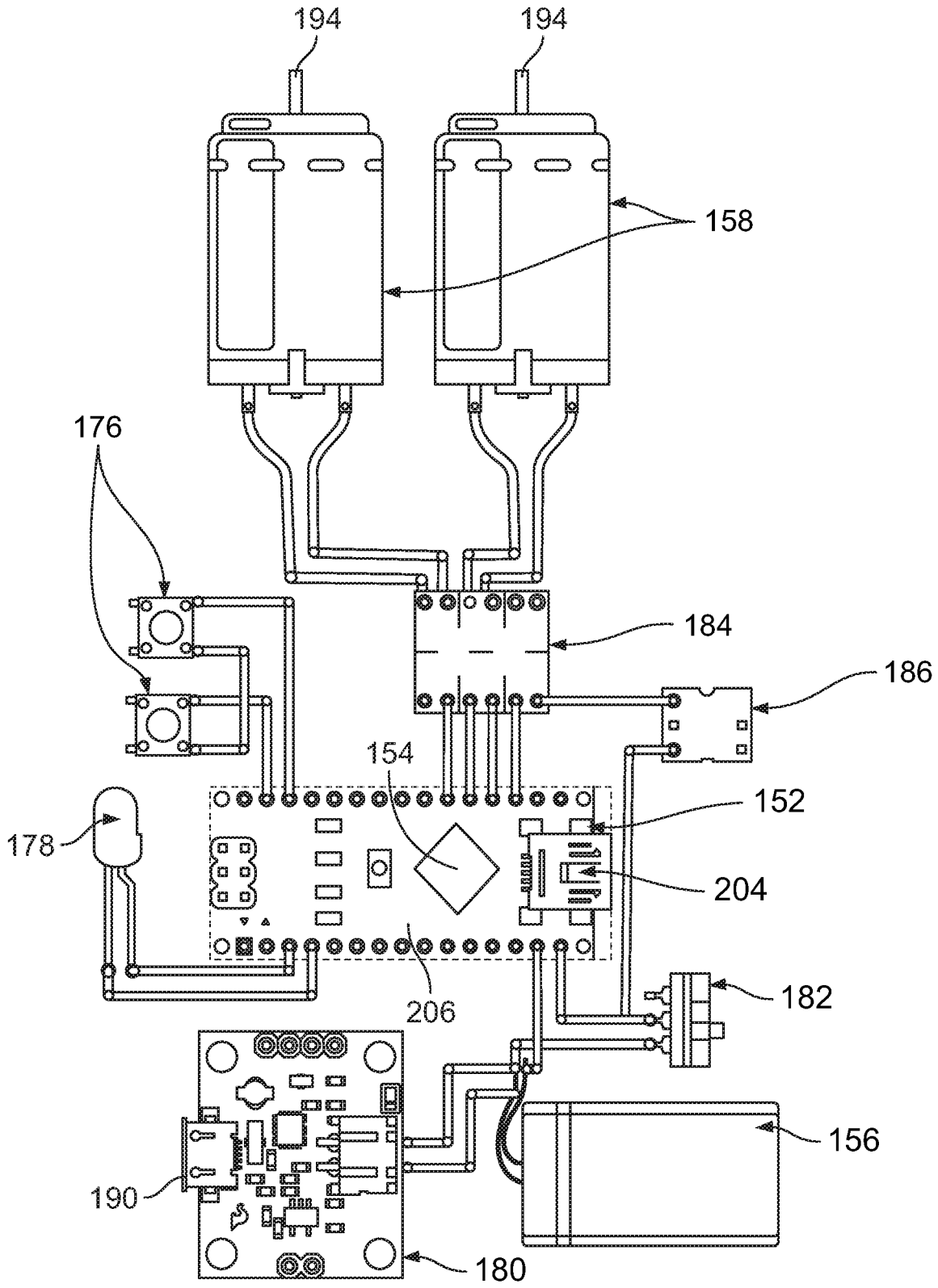
FIG. 22 is a schematic, circuit diagram view of electronics of the portable ankle cup of FIG. 17.

Referring now to FIGS. 20-22, the ankle cup 164 and, in particular, the housing 166, can house electronics of the active response system 150. Such electronics can include the controller 152, the motors 158, and the power source 156, as described above, as well as one or more buttons 176, one or more LEDs 178, a source charger 180, one or more switches 182, a motor driver 184 and, optionally, a voltage regulator 186. Furthermore, as shown in FIGS. 20 and 21, the housing 166 can include a plurality of apertures 188 configured to provide access to one or more of the buttons 176, the LED 178, the source charger 180, the switch 182, and/or the motors 158.

Still referring to FIGS. 20-22, in some embodiments, the buttons 176 can be in communication with the controller 152 and accessible from outside the housing 166. One button 176 may be adapted to receive user feedback when compression (i.e., cable tightening) is desired. Another button 176 may be adapted to receive user feedback when loosening is desired. In response to the user feedback (e.g., the user pressing one of the buttons 176), the controller 152 can actuate the motors 158 to tighten or loosen the cables 160. In some embodiments, the controller 152 can actuate the motors 158, via the motor driver 184, for a set time period or a set rotation number when the user presses one of the buttons 176. In other embodiments, the controller 152 can actuate the motors 158 for as long as the user is pressing a button 176, up to a maximum tightening or maximum loosening setting. As a result, a user can set a desired initial fit state of the article of footwear via the buttons 176. Furthermore, in some embodiments, the ankle cup 164 can include other mechanisms configured to receive user input to adjust compression of the upper 42, such as, but not limited to, dials, switches, touch screens, or other suitable input mechanisms. Additionally, in some embodiments, the ankle cup 164 does not include such buttons 176 or other input mechanisms that permit the user to adjust compression from the housing 166.

Still referring to FIGS. 20-22, the one or more LEDs 178 can be in communication with and controlled by the controller 152. The LED(s) 178 can also be viewable from outside the housing 166. The controller 152 can illuminate the LED(s) 178 to provide information to the user, such as indicating an "on" state, an "active" or "adjustment" state where the controller 152 is actuating the motors 158, a "fault" state if an error has occurred, one or more "calibration" states, or other information states. Such information can be provided in the form of the LED(s) 178 illuminating in a solid manner or a flashing manner at various rates. Furthermore, in some embodiments, each LED 178 can be a single-color LED or a multi-color LED (in which information can further be provided based on a specific color output of the particular LED 178).

Still referring to FIGS. 20-22, the source charger 180 can be coupled to the power source 156 and the controller 152 and can be configured to receive external power in order to recharge the power source 156 (such as a battery). For example, in some embodiments, the source charger 180 can include a communication port 190, such as a USB port or micro-USB port, accessible from outside the housing 166 and configured to be connected to a power cable. Furthermore, in some embodiments, the ankle cup 164 may not include a source charger 180 and, instead, incorporate one or more replaceable batteries as the power source 156.

Figure 26:
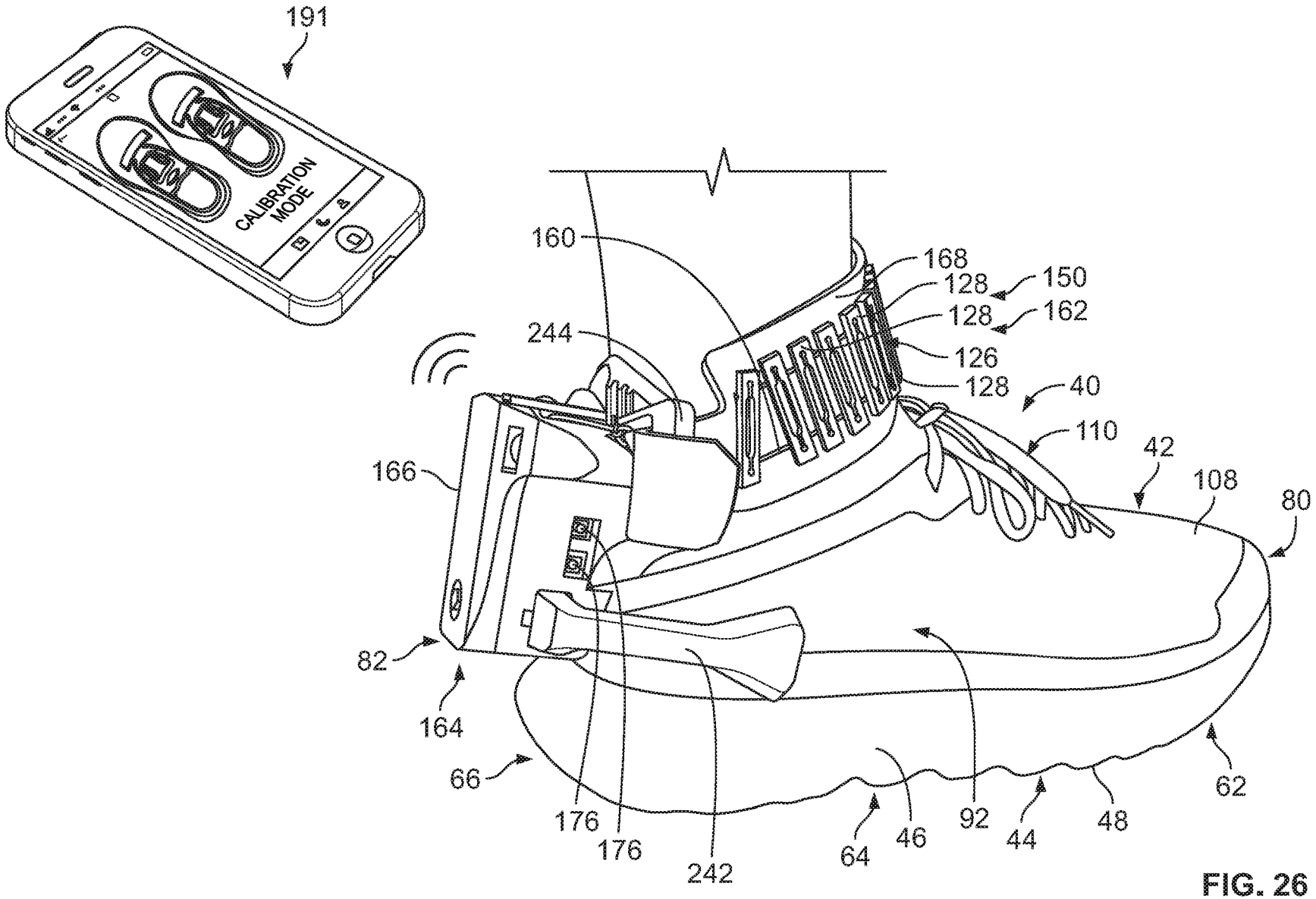
FIG. 26 is lateral view of a right shoe comprising an active response system with a portable ankle cup and an ankle strap.

Alternatively or additionally, the communication port 190 can be used to connect the controller 152 to a remote electronic device 191 (such as a cellular phone, as shown in FIG. 26, a tablet, a computer, a laptop, etc.), for example, for programming the controller 152, providing user data to the controller 152, uploading sensed data from the controller 152, or other communications. Furthermore, in some embodiments, the controller 152 can include an on-board transmitter/receiver configured to, for example, facilitate wireless communication between the controller 152 and the remote electronic device 191. For example, the transmitter/receiver can comprise a wireless communication module configured to communicate with the remote electronic device 191 via cellular, WiFi, Bluetooth, or other wireless transmission protocols.

The switch 182 can be in communication with the controller 152 and the power source 156 and be accessible from outside the housing 166. In some embodiments, the switch 182 can be an on/off switch that controls power from the power source 156 to the controller 152. Thus, to preserve the life of the power source 156, a user can turn off the ankle cup 164 when not in use by toggling the switch 182. Alternatively or additionally, in some embodiments, the controller 152 can receive and analyze feedback from one or more sensors 154 to determine when the ankle cup 164 is not in use (e.g., when the user is not wearing or moving the article of footwear 40, when the ankle cup 164 is detached from the article of footwear 40, etc.). When the controller 152 determines that the ankle cup 164 is in such a state, the controller 152 can enter a low power mode to preserve the life of the power source 156.

Still referring to FIGS. 20-22, as noted above, the motors 158 can be in communication with and controlled by the controller 152. More specifically, in some embodiments, the motors 158 can be micro gear motors coupled to the controller 152 via the motor driver 184. In some embodiments, the voltage regulator 186 can be coupled to the power source 156 and the motor driver 184 and can be configured to boost the voltage from the power source to a higher voltage needed to operate the motors 158, if necessary.

Figure 23:
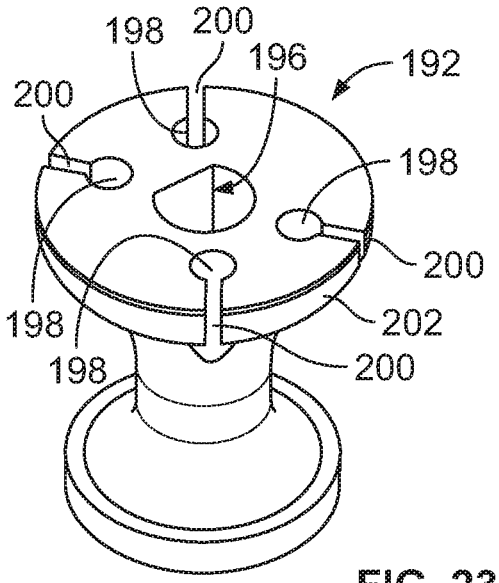
FIG. 23 is a perspective view of a spindle for use with a motor of the portable ankle cup of FIG. 17.

Referring to FIGS. 18, 20, 22, and 23, as noted above, each cable 160 can be coupled to a respective motor 158. More specifically, in some embodiments, the ankle cup 164 can include a spindle 192 coupled to a shaft 194 of each motor 158 to anchor and pull the cable 160 in response to motor shaft rotation. As shown in FIG. 23, the spindle 192 can include a shaft aperture 196 extending therethrough, configured to receive the motor shaft 194 in order to couple the spindle 192 to the motor shaft 194 (i.e., so that the spindle 192 rotates with the motor shaft 194). The spindle 192 can further include one or more cable apertures 198 extending at least through an upper portion thereof and each sized to receive at least one cable 160 therethrough. In some embodiments, each cable aperture 198 can be enclosed on all sides such that a cable 160 is routed through the cable aperture 198 by pushing or pulling the cable 160 therethrough. In other embodiments, as shown in FIG. 23, each cable aperture 198 can further include a pathway 200 extending to an outer surface 202 of the spindle 192. As a result, a cable 160 can be routed through the cable aperture 198 by sliding the cable 160 into the pathway 200 until it reaches the cable aperture 198. Accordingly, to adjust cable tension, a motor 158 is actuated, causing rotation of the spindle 192 to wind or unwind the cable 160 around the spindle 192.

In some embodiments, a single cable 160 may be routed through two cable apertures 198 of the spindle 192 in order to anchor the cable 160 to the spindle 192. As such, in some embodiments, the spindle 192 can include at least two cable apertures 198. However, in other embodiments, the spindle 192 can include more than two cable apertures 198. For example, as shown in FIG. 23, the spindle 192 includes four cable apertures 198 and, thus, may be configured to anchor two cables 160. Additionally, in some embodiments, as shown in FIGS. 18 and 20, the spindles 192 can be accessible from outside the housing 166, thus providing a user access to the spindles 192 to anchor the cables 160 thereon. For example, in some embodiments, a user can route a cable 160 through a links system 128 and/or cable guides 56, route the cable 160 through an aperture 188 of the housing 166, route the cable 160 around and anchor the cable 160 to the spindle 192, route the cable 160 back out the aperture 188 of the housing 166, and tie the cable 160 to itself to form a loop. Furthermore, in some embodiments, the cable 160 can comprise more than one cable 160 to facilitate easier installation for the user. Additionally, it should be noted that, while certain components are discussed herein as being accessible or viewable from outside the housing 166, in some embodiments, the housing 166 may include a cover (not shown) that covers such access but is removable to provide the user with such access when desired.

Referring back to FIG. 22, in some embodiments, the controller 152 may comprise a microcontroller 204 housed on a printed circuit board 206. The controller 152 can include one or more built-in, or on-board sensors 154, such as a 6-axis motion action sensor, as well as a wireless transmitter/receiver, as discussed above and a memory (not shown). The controller 152 can also include or communicate with additional sensors (not shown), such as additional force sensors, movement sensors, and/or accelerometers coupled to or embedded within the upper 42, the sole structure 44, and/or the portable ankle cup 164. Generally, the controller 152 can be configured to communicate with and control the other components of the ankle cup 164 (e.g., via connections on the printed circuit board 206, as shown in FIG. 22) in order to provide a dynamic, custom fit of the article of footwear 40 based on a user's movements.

Figure 24:
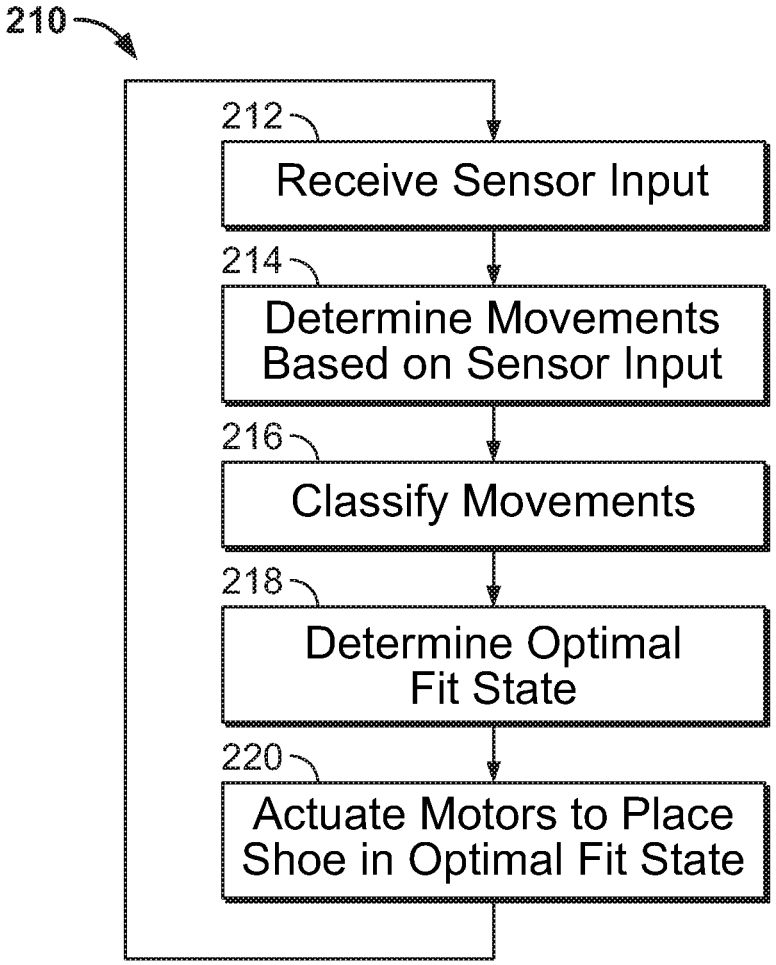
FIG. 24 is a flowchart of a method of use of an active response system in an article of footwear.

For example, referring now to FIG. 24, the active response system 150 can dynamically adjust a fit of the article of footwear 40 to a user's foot based on the user's movement. In particular, the controller 152 can be configured to carry out a method 210 as illustrated in FIG. 24. For example, at step 212, the controller 152 can receive data (i.e., inputs such as acceleration, gyration, force, etc.) from the sensor(s) 154. At step 214, the controller 152 can analyze such data to determine movements of the user. At step 216, the controller 152 can classify the movements as a specific activity based on algorithms stored in the memory. For example, the controller 152 can apply learning algorithms to find metrics and patterns indicative of specific actions. In one example, a sensed acceleration on the y-axis can indicate jumping movement. At step 218, based on the classified activity, the controller 152 can determine an optimal fit state that provides optimal support of the article of footwear 40 to the user for the activity. At step 220, the controller 152 can actuate the motors 158 in order to compress the upper 42 (or other compression zones) in a manner that achieves the optimal fit state.

More specifically, different activities may invoke different optimal fit states to optimally support the user's foot and/or ankle. For example, when idle, a user may desire a loose or medium fit of the article of footwear 40 in all compression zones. When laterally cutting, a user may desire a tighter fit around the forefoot region 62 to provide additional support and prevent the foot from sliding within the interior cavity 60. While taking off, such as running or jumping, a user may desire a looser fit around the ankle region 102 to provide maximum ankle mobility, as discussed above. When landing from a jump, a user may desire a more compressed fit around the ankle region 102 to provide maximum support to the ankle to help prevent rolling.

Accordingly, the controller 152 can be configured to include settings (such as compression settings) to achieve optimal fit states for all of the above-noted activities and/or other activities not specifically discussed herein. For example, in some embodiments, the compression settings may include or designate a position of each motor 58 to achieve an optimal fit state. Furthermore, the controller 152 can be configured to include settings (such as movement thresholds, including at least run thresholds and jump thresholds) to characterize movement data from the sensor(s) 154 as a particular activity. For example, the movement thresholds may be acceleration thresholds, multi-axis movement thresholds, pressure thresholds, and/or some combination of sensed thresholds. In some embodiments, these settings may be preset and stored within the memory of the controller 152. Furthermore, in some embodiments, the settings can be adjusted or reprogrammed via the buttons 176 and/or a remote electronic device 191 in communication with the controller 152.

Figure 25:
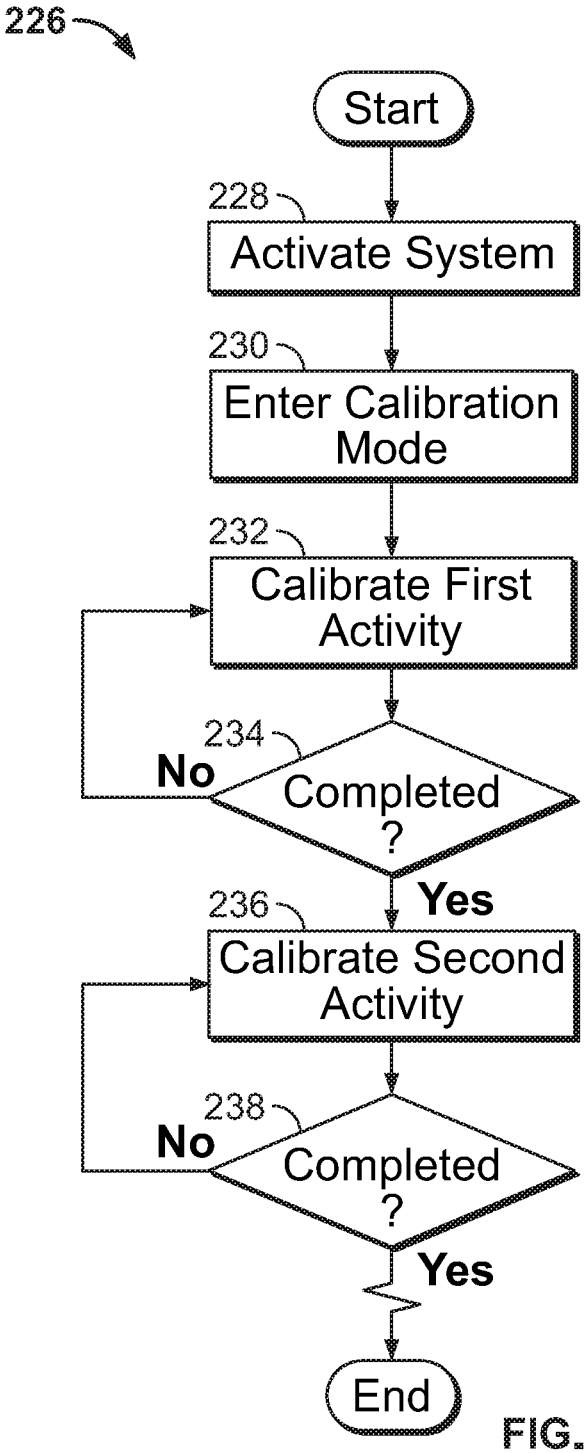
FIG. 25 is a flowchart of a calibration method of an active response system in an article of footwear.

In some embodiments, referring to FIG. 25, one or more of the above settings can be calibrated to a specific user. For example, the ankle cup 164 can be configured to analyze movements of the user while wearing the articles of footwear 40 and performing certain activities, retrieve data from the sensor(s) 154, and calculate averaged values from the data to set activity thresholds. More specifically, in some embodiments, the controller 152 can carry out a calibration method 226, as shown in FIG. 25.

Referring to the method 226 of FIG. 25, at step 228, a user can activate the controller 152 (e.g., by toggling the switch 182). At step 230, the user can enter a calibration mode. For example, in some embodiments, the user can simultaneously press both buttons 176 until the LED 178 begins flashing. However, other methods for entering the calibration mode may be contemplated in some embodiments. At step 232, the controller 152 can calibrate a first activity, such as a jumping activity. For example, in some embodiments, the user can press one button 176 until the LED 178 stops flashing, indicating the controller 152 is ready to collect data during the activity, and the user can then perform the first activity (such as jumping a certain number of times). The controller 152 can analyze this data to determine the particular movements that characterize one or more stages of the user's jump. The controller 152 can continue to record data until the first activity is completed, as determined at step 234. For example, the controller 152 can continue to record and analyze data until the user presses one of the buttons 176 to exit the first calibration. The analyzed data can then be stored in memory as thresholds for characterizing the first activity.

Referring still to FIG. 25, following step 234, in some embodiments, the LED 178 may again start flashing until the user presses one of the buttons 176, signaling the controller 152 to calibrate a second activity at step 236, such as a running activity. For example, in some embodiments, the user can press one button 176 until the LED 178 stops flashing, indicating the controller 152 is ready to collect data during the second activity, and the user can then perform the second activity (such as running for a certain time period). The controller 152 can analyze this data to determine the particular movements that characterize different stages of the user's run. The controller 152 can continue to record data until the second activity is completed, as determined at step 238. For example, the controller 152 can continue to record and analyze data until the user presses one of the buttons 176 to exit the second calibration. The analyzed data can then be stored in memory as thresholds for characterizing the second activity.

In some embodiments, the controller 152 calibrates the two activities, and the process 226 is completed. For example, the user can again simultaneously press both buttons 176 to exit the calibration mode. However, in some embodiments, the controller 152 can calibrate additional activities. In such embodiments, the same process discussed above for steps 232 and 234, or steps 236 and 238, can be repeated for the additional activities until the user completes the calibration.

Furthermore, in some embodiments, the process 226 described above can be performed by the user interacting only with the ankle cup 164 (e.g., via the buttons 176 and the LEDs 178). However, in some embodiments, the process 226 can be performed by the user interacting with the ankle cup 164 and/or a remote electronic device 191 wirelessly coupled to the ankle cup 164, as shown in FIG. 26. For example, the remote electronic device 191 can guide the user through the calibration process 226 by instructing which activities to perform and for how long. Additionally, in some embodiments, the remote electronic device 191 can further receive input from the user regarding desired optimal fit states for each activity, as different users may desire different compression states in specific activities. Based on this user feedback, the controller 152 can update or adjust the threshold settings to achieve optimal fit states specific to the user. In some embodiments, the compression settings may also be updated by a user via the ankle cup 164 (e.g., via the buttons 176).

Figure 27:
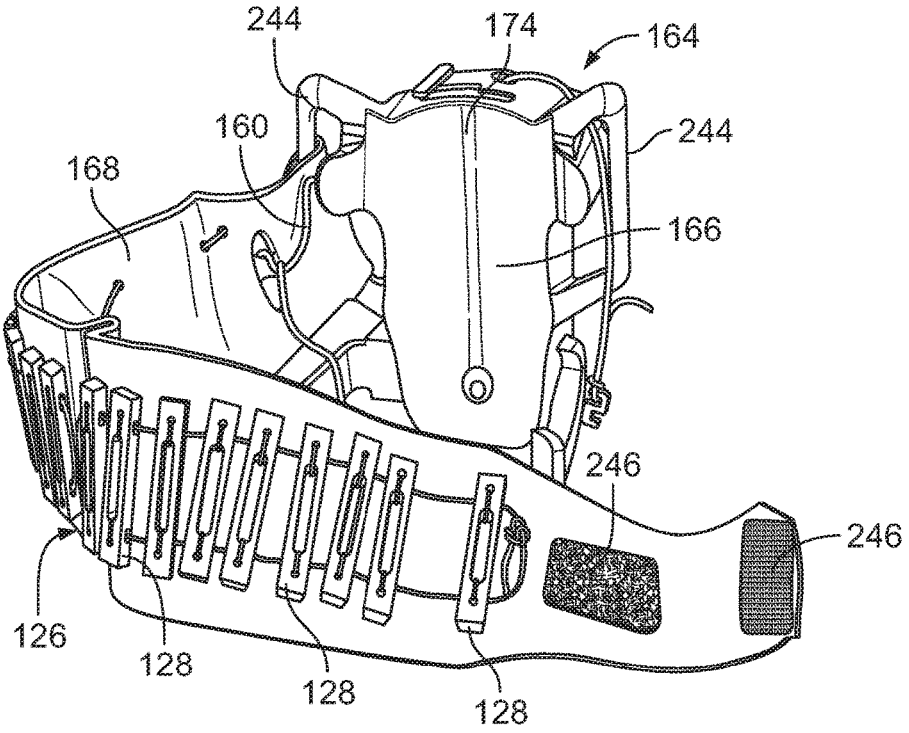
FIG. 27 is front perspective view of the portable ankle cup, with clamping mechanisms removed, and the ankle strap of FIG. 26.

FIGS. 26-32 illustrate additional articles of footwear 40, according some embodiments, incorporating one or more features or characteristics described above with respect to FIGS. 15-25. For example, FIGS. 26 and 27 depict an article of footwear 40, according to some embodiments, with an active response system 150 with a portable ankle cup 164. The portable ankle cup 164 can include a housing 166 configured to be removeably coupled to the upper 42 and, more specifically, to the heel counter 50. The active response system 150 can include a compression zone 162 defined by an ankle strap 168 configured to be wrapped around a user's ankle and coupled to at least one cable 160 that is connected to and maneuverable by the motor 158 in the housing 166 of the ankle cup 164.

Still referring to FIGS. 26 and 27, housing 166 can be configured similar to the housing 166 described above with respect to FIGS. 16-22, and can further includes stabilizing clamps 242 coupled to lateral and medial sides thereof in order to help hold the housing 166 against the article of footwear 40. For example, in some embodiments, the clamps 242 can be configured to include spring-like features to press inward against the article of footwear 40. In some embodiments, this additional clamping feature can help minimize vibrations of the ankle cup 164, reducing errors in the sensor readings.

Still referring to FIGS. 26 and 27, the housing 166 can further include loops 244 through which the ankle strap 168 may be routed. For example, in some embodiments, as shown in FIG. 27, the ankle strap 168 can be coupled to a first loop 244, for example, by the ankle strap 168 being routed through the first loop 244 and stitched onto itself. The ankle strap 168 can further be removably coupled to a second loop 244, for example, by the ankle strap 168 being routed through the second loop 244 and fastened to itself, such as with mating hook and loop fasteners 246, buttons, or other removable coupling mechanisms.

Accordingly, to use the active response system 150 of FIGS. 26 and 27, the housing 166 can be coupled to a guide 170 on the article of footwear, and the ankle strap 168 can be wrapped around the user's ankle and coupled to itself. This configuration may be beneficial, for example, for use with articles of footwear 40 having a low-profile ankle region 102.

Figure 28:
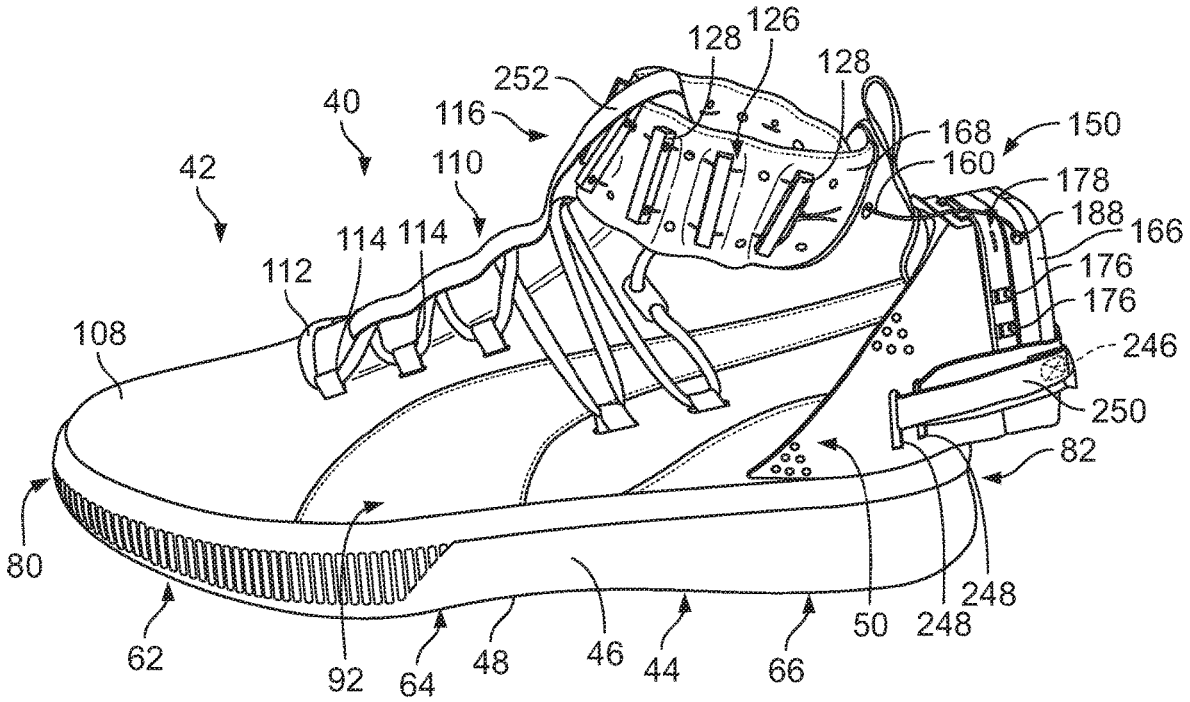
FIG. 28 is lateral view of a left shoe comprising an active response system with a portable ankle cup according to another configuration.
Figure 29:
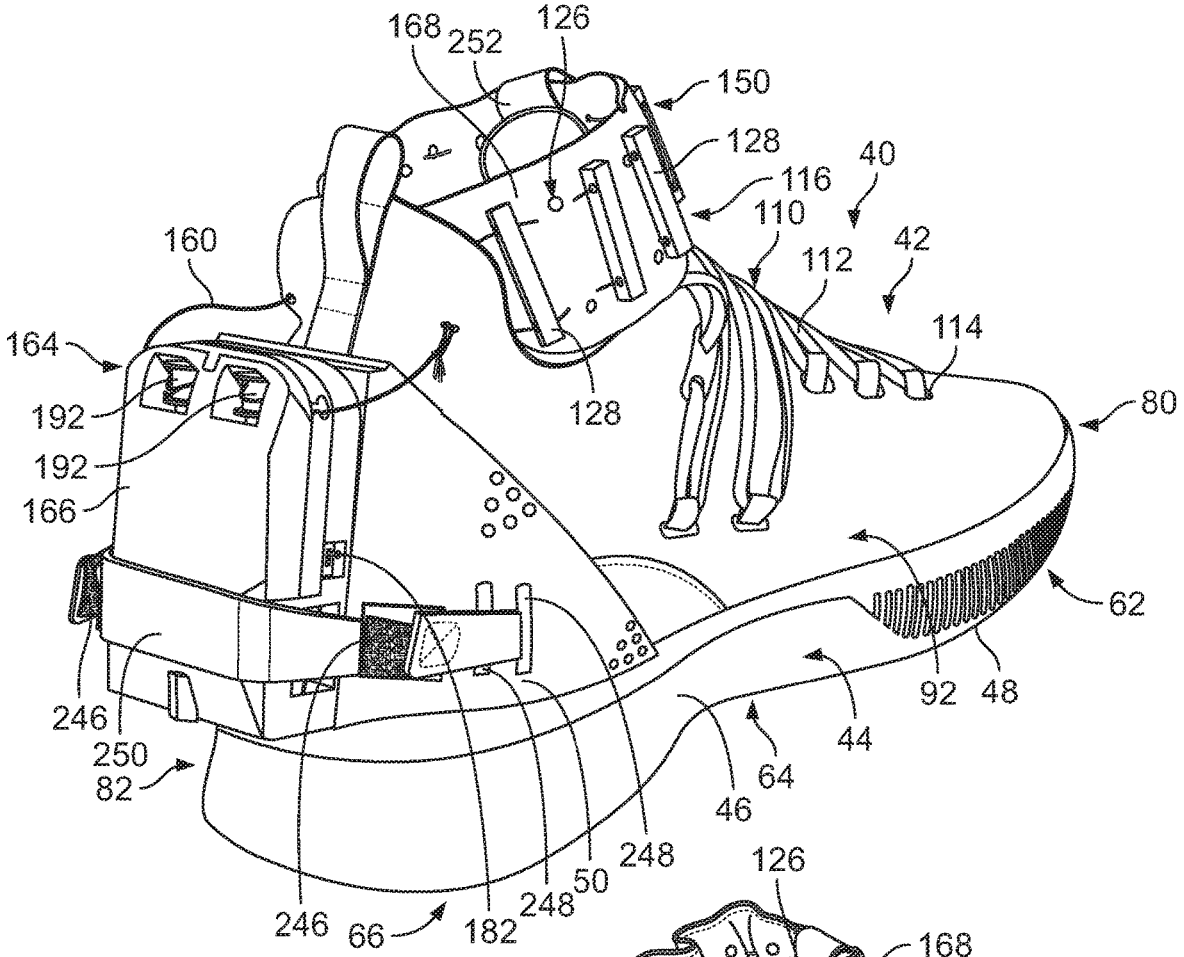
FIG. 29 is a medial view of the left shoe of FIG. 28 comprising the active response system with a portable ankle cup.

Referring now to FIGS. 28 and 29, another article of footwear 40 is depicted, comprising an active response system 150 with a portable ankle cup 164. The portable ankle cup 164 can include a housing 166 configured to be removeably coupled to the upper 42 and, more specifically, to the heel counter 50. For example, the article of footwear 40 can include a heel counter 50 that includes a guide (not shown) as well as medial and lateral apertures 248 configured to receive one or more stabilizing straps 250 therethrough. More specifically, the housing 166 can be coupled to the heel counter 50 in a similar manner as described above (e.g., via a guide and track mechanism, not shown, or another mechanism). Once coupled to the heel counter 50, a stabilizing strap 250 can be positioned around a rear surface of the housing 166, routed through each of the medial and lateral apertures 248, and fastened to itself, for example, via mating hook and loop fasteners 246, buttons, or other removable coupling mechanisms. In this manner, the stabilizing strap 250 can tighten and stabilize the housing 166 against the heel counter 50 in order to minimize vibrations of the ankle cup 164, reducing errors in the sensor readings. In some embodiments, the heel counter 50 of FIGS. 28 and 29 can be a secondary heel counter coupled to a primary heel counter of the article of footwear 40, or can be integrated into the article of footwear as the primary heel counter.

Referring still to FIGS. 28 and 29, the active response system 150 can include a compression zone 162 defined by an ankle strap 168 configured to be wrapped around a user's ankle and coupled to the upper 42 and at least one cable 160 that is connected to and maneuverable by the motor 158 in the housing 166 of the ankle cup 164. For example, as shown in FIGS. 28 and 29, the ankle strap 168 can be a separate strap at least routed through an upper loop 252 of the lacing system 110 to help maintain the ankle strap 168 around a user's ankle adjacent the upper 42. Additionally, as shown in FIGS. 28 and 29, the cable 160 can be routed through the material of the upper 42 (or dedicated apertures within the upper 42) when routed from the portable ankle cup 164 to the ankle strap 168.

Figure 30:
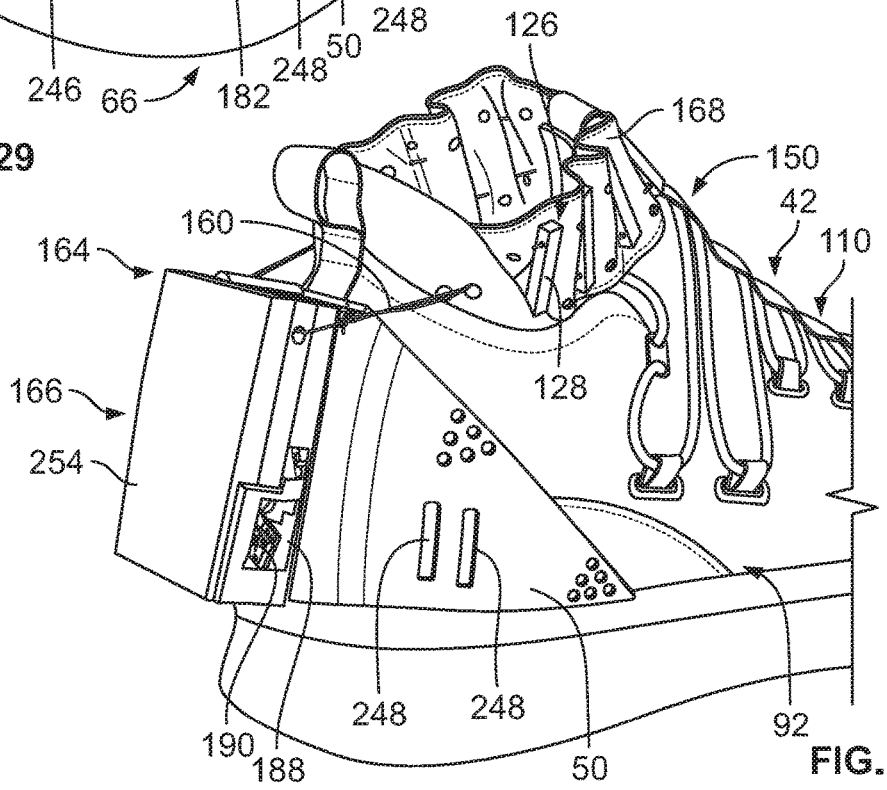
FIG. 30 is a lateral view of a right shoe comprising an active response system with a portable ankle cup according to another configuration.

Furthermore, FIG. 30 depicts an article of footwear 40 with a similar active response system 150 to that of FIGS. 28 and 29, with a different housing 166. More specifically, the housing 166 can include a rear cover 254 that covers certain apertures 188 (such as the apertures 188 that provide access to the spindles 192).

Figure 31:
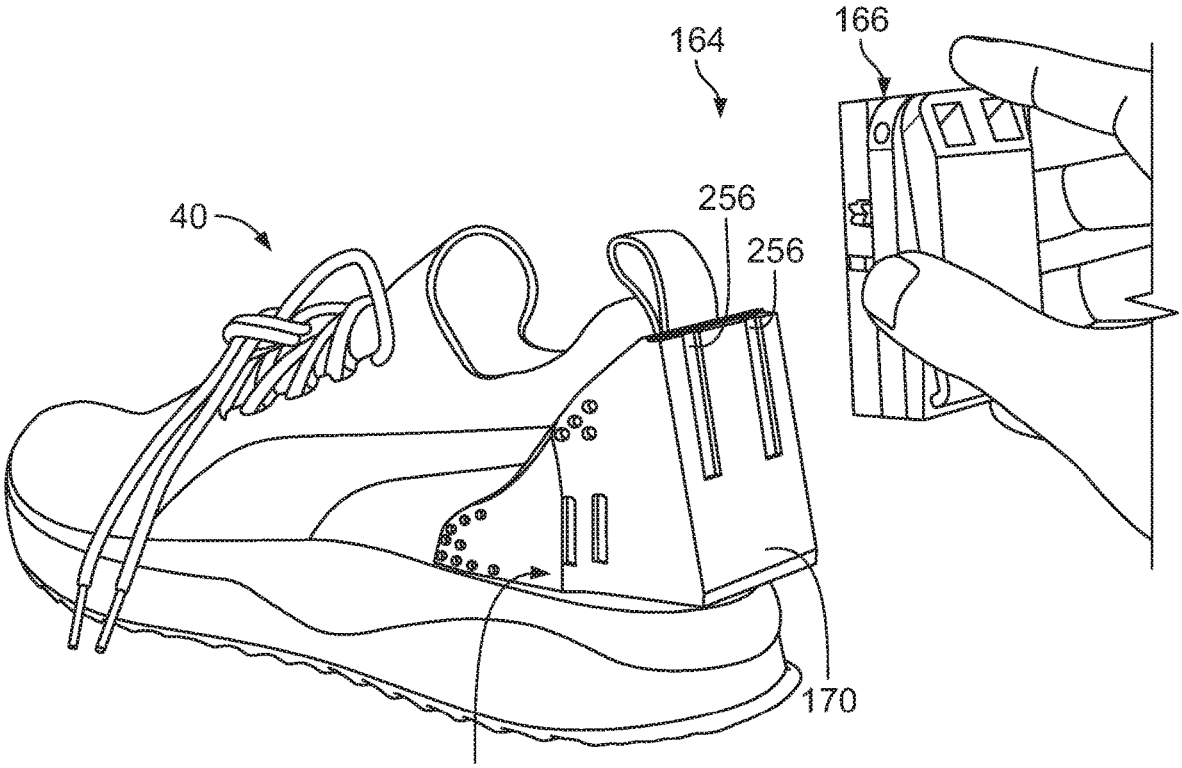
FIG. 31 is a lateral view of a left shoe comprising an active response system with a portable ankle cup, according to yet another configuration, detached from the shoe.
Figure 32:
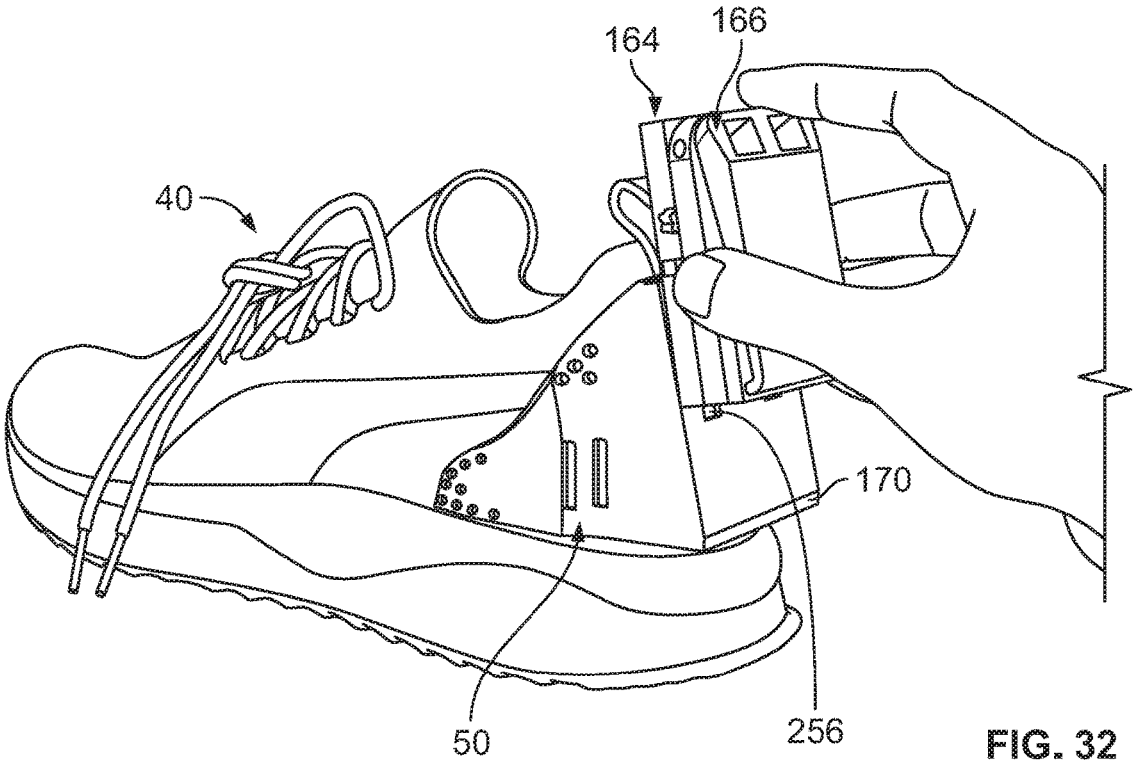
FIG. 32 is a lateral view of the left shoe of FIG. 31 with the portable ankle cup partially attached to the shoe.

FIGS. 31 and 32 depict an article of footwear 40 with a similar active response system 150 to that of FIGS. 28 and 29. In particular, the portable ankle cup 164 can include a housing 166 configured to be removeably coupled to the upper 42 and, more specifically, to the heel counter 50. As shown in FIGS. 31 and 32, the heel counter 50 can include one or more tracks 256 through which a guide (not shown) on a front of the housing 166 can be routed. Thus, as shown in FIG. 32, a user can slide the housing 166 onto the tracks 256 of the heel counter 50.

Any of the embodiments described herein may be modified to include any of the structures or methodologies disclosed in connection with different embodiments. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An article of footwear for a user, comprising:

a sole structure comprising a midsole and an outsole;

an upper attached to the sole structure, the upper defining a forefoot region, a midfoot region, and a heel region of the article of footwear, the upper further defining a foot region and ankle region of the article of footwear;

an adaptive actuation system coupled to the upper, the adaptive actuation system comprising a plurality of cable guides and a cable configured to compress a portion of the upper in response to movement of at least one of the sole structure or the upper by the user, wherein the cable is wrapped around the ankle region and configured to compress the ankle region, wherein the plurality of cable guides includes a rear guide disposed at a rear end of the upper, the rear guide including an upper channel and a lower channel; and a links system configured to distribute compressive forces from the cable around the ankle region, wherein the links system comprises a plurality of links coupled to the upper and spaced around the ankle region, wherein the cable is routed through an aperture of each of the plurality of links and the cable extends from the upper channel through the plurality of links that are disposed on a medial side, and the cable further extends from the lower channel through the plurality of links that are disposed on a lateral side, wherein the plurality of links include a plurality of moveable links and an anchor link, the plurality of moveable links each comprising a first aperture having a first diameter that is configured to produce a first friction between an inner surface of the first aperture and the cable, and the anchor link comprising a second aperture having a second diameter that is configured to produce a second friction between an inner surface of the second aperture and the cable, and wherein the second diameter is greater than the first diameter, the second friction is less than the first friction, and a motion of the cable is configured to move the moveable links more than the motion of the cable is configured to move the anchor link.

2. The article of footwear of claim 1, wherein the adaptive actuation system is a preload system comprising the cable and the plurality of cable guides configured to couple the cable to the upper, wherein the cable is coupled to the upper at a first anchor point adjacent a front end of the upper in the forefoot region, and is looped from the first anchor point toward the rear end of the upper, wrapped around the ankle region back toward the rear end of the upper, and back to the first anchor point, and wherein tightening of the cable causes the ankle region to be compressed.

3. The article of footwear of claim 2, wherein the preload system further comprises a disc configured to be coupled to the upper and receive the cable, wherein the disc can be manipulated to one of tighten or loosen the cable.

4. The article of footwear of claim 2, wherein flattening of the midsole causes the cable to tighten and curving of the midsole causes the cable to loosen.

5. The article of footwear of claim 2, wherein the cable is coupled to one of the upper or the sole structure at a second anchor point adjacent a widest portion of the sole structure at a lateral side thereof, and is coupled to one of the upper or the sole structure at a third anchor point adjacent the widest portion of the sole structure at a medial side thereof.

6. An article of footwear for a user, comprising:

a sole structure comprising a midsole and an outsole;

an upper attached to the sole structure, the upper defining a forefoot region, a midfoot region, and a heel region of the article of footwear, the upper further defining a foot region and an ankle region of the article of footwear;

an adaptive actuation system coupled to the upper, the adaptive actuation system comprising a plurality of cable guides and a cable configured to compress a portion of the upper in response to movement of at least one of the sole structure or the upper by the user, wherein the cable is wrapped around the ankle region and is configured to compress the ankle region, wherein the plurality of cable guides includes a rear guide disposed at a rear end of the upper, the rear guide including an upper channel and a lower channel; and a links system configured to distribute compressive forces from the cable around the ankle region, wherein the links system comprises a plurality of links coupled to the upper and spaced around the ankle region, wherein the cable is routed through an aperture of each of the plurality of links, and the cable extends from the upper channel through the plurality of links that are disposed on a medial side, wherein the cable extends from the lower channel through the plurality of links that are disposed on a lateral side, wherein the plurality of links include a plurality of moveable links and an anchor link, the plurality of moveable links each comprising a first aperture having a first diameter, and the anchor link comprising a second aperture having a second diameter, and the second diameter is greater than the first diameter, and wherein the plurality of moveable links are configured to move toward the anchor link when the cable is pulled by a user.

7. The article of footwear of claim 3, wherein the disc is configured to receive the cable from the upper channel along the medial side, and wherein the disc is configured to receive the cable from the lower channel along the lateral side.

8. The article of footwear of claim 1, wherein a wedge having a triangular cross section shape extends from the midsole, and wherein the wedge extends across an entire width of the sole structure.

9. The article of footwear of claim 8, wherein a base of the wedge is adjacent the outsole and at least partially contacts an exterior surface when the article of footwear is worn.

10. The article of footwear of claim 8, wherein the wedge comprises a material that is more rigid than the material of the midsole or the outsole.

11. The article of footwear of claim 1, wherein the lateral side and the medial side of the upper each include a plurality of anchor links.

12. The article of footwear of claim 1, wherein the links system includes eight links.

13. The article of footwear of claim 1, wherein the links system includes links positioned along an interior surface of the upper and an exterior surface of the upper, and wherein the cable is woven through the upper and routed through apertures of both the links on the exterior surface and the interior surface.

14. The article of footwear of claim 1, wherein the plurality of links are flexible links capable of bending to a contour of a user's ankle when coupled to the upper.

15. The article of footwear of claim 1, wherein the plurality of links each include a long edge and a short edge, and wherein each of the long edges of the plurality of links extend substantially vertically.

* * * * *